US012703556B2

(12) United States Patent
Searle et al.

(10) Patent No.: US 12,703,556 B2
(45) Date of Patent: Aug. 11, 2026

(54) VACUUM PUMP AND VALVE SYSTEM FOR USE WITH VACUUM-RETENTION SYSTEM

(71) Applicant: GSTC LLC, Scottsdale, AZ (US)

(72) Inventors: Gideon P. Searle, Scottsdale, AZ (US); Jamey Reed, Gilbert, AZ (US); Daniel Reed, Gilbert, AZ (US); Robert Fulbright, Gilbert, AZ (US)

(73) Assignee: GSTC LLC, Scottsdale, AZ (US)

( * ) Notice: Subject to any disclaimer, the term of this patent is extended or adjusted under 35 U.S.C. 154(b) by 126 days.

(21) Appl. No.: 18/768,921

(22) Filed: Jul. 10, 2024

(65) Prior Publication Data

US 2026/0015151 A1 Jan. 15, 2026

(51) Int. Cl.

| | |
|---|---|
| ***B65D 81/20*** | (2006.01) |
| ***B65D 41/02*** | (2006.01) |
| ***B65D 53/02*** | (2006.01) |
| ***B65D 55/16*** | (2006.01) |

(52) U.S. Cl.

CPC ..... *B65D 81/2038* (2013.01); *B65D 41/023* (2013.01); *B65D 53/02* (2013.01); *B65D 55/16* (2013.01)

(58) Field of Classification Search

CPC ..... B65D 81/2038; B65D 53/02; B65D 55/16
USPC ..... 141/65
See application file for complete search history.

(56) References Cited

U.S. PATENT DOCUMENTS

| | | | | |
|---|---|---|---|---|
| 4,565,506 | A | 1/1986 | Williams | |
| 4,979,883 | A | 12/1990 | Neward | |
| 5,031,785 | A | 7/1991 | Lemme | |
| 5,362,214 | A | 11/1994 | Neward | |
| 5,405,038 | A | 4/1995 | Chuang | |
| 5,450,924 | A * | 9/1995 | Tseng | F01M 11/045 137/202 |
| 6,474,443 | B2 * | 11/2002 | Kearns | F01M 11/045 137/205 |
| 7,140,402 | B2 | 11/2006 | Russell | |
| 8,607,832 | B2 | 12/2013 | Ferlito et al. | |
| 11,021,311 | B2 | 6/2021 | Pace et al. | |
| 11,109,987 | B2 | 9/2021 | McLoone | |
| 2007/0034542 | A1 | 2/2007 | Cerreta | |
| 2007/0212239 | A1 | 9/2007 | Heil et al. | |
| 2008/0309071 | A1 | 12/2008 | Carboneri et al. | |
| 2009/0256100 | A1 * | 10/2009 | Lee | F16K 3/243 251/331 |
| 2020/0359866 | A1 | 11/2020 | Tsai et al. | |

* cited by examiner

*Primary Examiner* — Jason K Niesz
(74) *Attorney, Agent, or Firm* — Neo IP

(57) ABSTRACT

A valve assembly controls the flow of air into and out of a vacuum retention system, which includes microbeads. The valve assembly is sealed and operable to tightly connect to a vacuum pump assembly. The vacuum pump assembly is able to apply negative pressure to evacuate air from the vacuum retention system through the valve assembly. The vacuum pump assembly includes a tube sealed by click connected overmolds on each end, where the overmolds include pores allowing air to push out of the system.

12 Claims, 27 Drawing Sheets

VACUUM PUMP AND VALVE SYSTEM FOR USE WITH VACUUM-RETENTION SYSTEM

BACKGROUND OF THE INVENTION

1. Field of the Invention

The present invention relates to pump and valve systems, and more specifically to pumps and valves configured to evacuate air from a vacuum retention system.

2. Description of the Prior Art

It is generally known in the prior art to provide vacuum pumps and valves configured to connect to vacuum pumps.

Prior art patent documents include the following:

U.S. Pat. No. 4,565,506 for Hand operated vacuum pump by inventor Williams, filed Mar. 13, 1984 and issued Jan. 21, 1986, discloses an improved hand-operated vacuum pump including a cylinder, head assembly, and elastic seal member. The cylinder and head assembly define opposing grooves, and the elastic seal member is positioned in the grooves to secure the head assembly to the cylinder. A piston assembly is operative within the cylinder to draw a vacuum within the head assembly.

U.S. Pat. No. 5,362,214 for Multi-vacuum release for pump by inventor Neward, filed Sep. 8, 1993 and issued Nov. 8, 1994, discloses a hand-held vacuum pump with an attached vacuum release valve. The vacuum release valve is oriented so that the hand-held vacuum pump and the vacuum release valve can be operated with the same hand. The vacuum release valve is operated using a trigger, allowing the operator to easily and controllably release the vacuum. The trigger is shaped to allow the operator to vary the vacuum release rate without changing the physical features of the mechanism. Further, a detachable trigger extension is disclosed which will enable operator's with small hands to operate the device with one hand.

U.S. Pat. No. 7,140,402 for Vacuum storage system and method by inventor Russell, filed Dec. 15, 2004 and issued Nov. 28, 2006, discloses a system and method for providing and releasing a vacuum seal comprising inter alia: puncturing a portion of a lid closure with a penetrator device; actuating a vacuum pump to remove at least a portion of atmospheric gas from inside the containment vessel via the puncture hole; and sealing the puncture with a laminar valve or thin film held in place with PST or other suitable adhesive. Disclosed features and specifications may be variously controlled, adapted or otherwise optionally modified to improve release and/or re-establishment of a vacuum seal for any application or operating environment. Embodiments of the invention generally provide for quick, easy and safe opening and resealing of vacuum packaged containers for food products.

US Patent Pub. No. 2020/0359866 for Vacuum pump lid for cannisters by inventors Tsai et al., filed May 13, 2020 and published Nov. 19, 2020, discloses a vacuum pump lid that can be applied to any cannister. The lid integrates with the closure system of the cannister, whether it be by threads, push or snap closures, or the like. With the pumping of a button on the top of the lid, a pliable valve pin operates to remove a small amount of air from the cannister to achieve a vacuum seal. The seal is released when the lid is removed. The simple solution uses few moving parts to achieve the results, making it sturdy and faster to produce.

U.S. Pat. No. 4,979,883 for Vacuum limiter for pump by inventor Neward, filed Sep. 27, 1989 and issued Dec. 25, 1990, discloses a small and compact vacuum pump which serves as a portable vacuum source. The pump basically includes a cylinder coupled with a handle, and a piston in the cylinder coupled with another handle, along with a suitable valving assembly for allowing a vacuum to be drawn at an inlet of the pump. More particularly, there is also disclosed a vacuum limiter which can be attached to or form an integral part of the pump. The vacuum limiter includes an assembly having a pair of valves one of which is adjustable for allowing the limit vacuum to be set. The adjustable valve is a metering check valve and the second valve is a holding check valve upstream of the first.

US Patent Pub. No. 2008/0309071 for Split joint for vacuum pumps and method for obtaining thereof by inventors Tsai et al., filed May 13, 2020 and published Nov. 19, 2020, discloses a split joint for vacuum pumps, suitable for establishing the mechanical connection and vacuum seal between the suction inlet of a vacuum pump and an evacuation outlet of a structure to which the pump is to be connected; said split joint comprising a male joint equipped with a plurality of male engagement elements connectable to the outer case of a vacuum pump or to the structure to which the pump is to be connected; said male engagement elements providing the mechanical connection with corresponding female engagement elements of the corresponding female joint; wherein the mechanical connection is achieved by a relative rotating movement between said male joint and said female joint.

US Patent Pub. No. 2007/0034542 for Vacuum seal bag assembly by inventor Cerreta, filed Aug. 11, 2006 and published Feb. 15, 2007, discloses a vacuum seal bag assembly that comprises of a plastic Ziploc® bag having a plastic snap-open snap-closed one-way air sealed connector incorporated into one side of the Ziploc® bag, and a hand pump bulb that attaches to the one-way air sealed connector. This one-way air sealed connector includes a plastic nipple from a beach ball. A hand pump works in combination with the one-way sealed connector as the vacuum source which evacuates air contained inside the Ziploc® bag. When all of the air is squeezed out, the one-way air sealed connector is closed and the bag is sealed. The invention is fabricated of lightweight materials and possesses a simple, yet scalable, design that may be economically manufactured and sold to provide for widespread use.

U.S. Pat. No. 8,607,832 for Vacuum packaging in containers provided with an air-tight closing lid by inventors Ferlito et al., filed Jun. 29, 2010 and issued Dec. 17, 2013, discloses a vacuum seal valve applied to a lid for the air-tight closing of a container for the packaging of products, particularly food products, including a closing body arranged for sealing a hole for evacuating air from the container, from which at least one punching member stems that is adapted to pierce the lid closing the container so as to form such evacuating hole. A reciprocating mechanical vacuum pump, with manual actuation, evacuates air from a container arranged for the vacuum packaging of products, for example food products, via application of the vacuum sealing valve. The pump has, at its base, a recess adapted to form a housing for retaining the valve, whereby the lowering movement of the plunger allows driving the valve in a lid of the container.

U.S. Pat. No. 5,405,038 for Vacuum food container device by inventor Chuang, filed Dec. 2, 1993 and issued Apr. 11, 1995, discloses a device having three main components: a storage container, an air-tight lid and a pump for extracting air. The storage container is distinguished by a ring-shaped protrusion in the concave bottom of the container. This protruding ring is designed to fit tightly into a concave ring on the lid of another container of the same design. This feature enables the containers to be stacked conveniently on top of one another. The storage container is further distinguished by an elevated lip on the upper rim of the container, which forms an air-tight seal with the lid. The lid is distinguished by a vacuum valve containing two layers with several holes in each layer. The vacuum valve contains an umbrella-shaped silicon piece, which can bend upwards to allow air to be drawn out by the pump, but is restricted from bending downwards (which would allow air to enter the container).

U.S. Pat. No. 11,021,311 for Vacuum container for storage of air sensitive materials by inventors Pace et al., filed Nov. 5, 2018 and issued Jun. 1, 2021, discloses a storage container apparatus for storing air sensitive materials under a vacuum. The apparatus includes having a cylindrical container body opened at its upper end and a cap apparatus with an integral air pump to evacuate air from the container body to create a vacuum. The cap apparatus comprises an inner cap with a one-way air valve and an outer cap. The outer cap is slidably nested over the inner cap and confines a central air chamber which fills with air from the container body through the one-way air valve when pulled upwardly in a reciprocating motion. In the down stroke the air is evacuated from the air chamber through vents. The outer cap may include locking mechanism and vacuum level indicator. The outer cap may include an activated carbon cloth insert that suppresses odors from the material stored in the container.

U.S. Pat. No. 5,031,785 for Combination vacuum/pressure pump and valve stopper for food or drink containers by inventor Lemme, filed Apr. 19, 1990 and issued Jul. 16, 1991, discloses a combination pressure and vacuum pump for food or drink containers including a pump housing having a pump cylinder therein, a pump head adapted for sealing engagement with a valve stopper on a food or drink container, and a piston in sliding airtight engagement with the pump cylinder; the pump cylinder, pump head and piston defining a pump chamber. A handle is provided for moving the piston and the pump cylinder relative to one another to pump a gas into or out of the food or drink container. The pump chamber is connected to the valve stopper via a first opening when the pump head is sealed to the valve stopper and to the atmosphere via a second opening through a combination pressure and vacuum valve, the combination valve being switchable from a vacuum position to a pressure position. A combination pressure and vacuum valve stopper is also shown which includes a valve element reversible between a pressure position and a vacuum position to convert the stopper between pressure and vacuum use.

U.S. Pat. No. 11,109,987 for Vacuum device for a prosthetic by inventor McLoone, filed Feb. 27, 2020 and issued Sep. 7, 2021, discloses a manually-operated device, that is affixed to or integral with a prosthetic socket. The manual operation allows a wearer to increase the vacuum in the socket cavity if there is any noticeable decrease at any time. The Prosthetic Vacuum Pump includes a removable pump mechanism that allows a user to customize the level of vacuum drawn by the Prosthetic Vacuum Pump. The intake valve of the Prosthetic Vacuum Pump is in direct connection with the cavity of a prosthetic socket. By eliminating vacuum lines, the vacuum pump creates an immediate vacuum in the cavity. The result is an immediate suspension when the prosthetic limb is put on without the need to walk or wait for the battery to draw a sufficient vacuum. The compact construction and optional depress-lock is easily hidden beneath clothing.

US Patent Pub. No. 2007/0212239 for Vacuum hand pump and vacuum sealable bag valve system and method by inventors Heil et al., filed Mar. 9, 2007 and published Sep. 13, 2007, discloses a vacuum hand pump and valve system which fits in the palm of a hand and has a deployable crank handle used to turn a vane in order to create a vacuum in a container.

SUMMARY OF THE INVENTION

The present invention relates to pump and valve systems, and more specifically to pumps and valves configured to evacuate air from a vacuum retention system.

It is an object of this invention to provide a pump and valve system for withdrawing air from a vacuum retention system.

In one embodiment, the present invention is directed to a valve assembly for a vacuum retention system, including a valve flange integrated with a surface of the vacuum retention system, wherein the valve flange includes a central opening connecting an external environment to an interior of the vacuum retention system, a valve body inserted into the central opening of the valve flange, wherein prongs extend downwardly from the valve body that are configured to clasp onto a retaining ring of the valve flange, thereby preventing the valve body from being pulled out of the valve flange, at least one sealing element connected to the valve body, preventing ingress of air into the interior of the vacuum retention system when the valve assembly is in a closed position, a diaphragm within an upper recess of the valve body, wherein the diaphragm is configured to limiting air flow through the valve assembly to a single direction, and a valve body insert within the upper recess of the valve body, above the diaphragm.

In another embodiment, the present invention is directed to a vacuum pump assembly for withdrawing air from a vacuum retention system, including a hollow tube, wherein a plurality of tabs extending outwardly from an exterior surface of the hollow tube, a bottom overmold component including a first plurality of clasps each with openings configured to matingly engage with the plurality of tabs, a top overmold component including a second plurality of clasps each with openings configured to matingly engage with the plurality of tabs, an internal filter within the hollow tube including a first plurality of air pores, and a handle, wherein an attachment opening is defined in a bottom end of the bottom overmold component, wherein the attachment opening includes a hollow cylinder having a second plurality of air pores, wherein a central handle opening, into which the handle is inserted, is defined through a center of the top overmold component, and wherein a third plurality of air pores are defined in the top overmold component surrounding the central handle opening.

In yet another embodiment, the present invention is directed to a vacuum pump assembly for withdrawing air from a vacuum retention system, including a hollow tube, wherein a plurality of tabs extending outwardly from an exterior surface of the hollow tube, a bottom overmold component including a first plurality of clasps each with openings configured to matingly engage with the plurality of tabs, a top overmold component including a second plurality of clasps each with openings configured to matingly engage with the plurality of tabs, and a handle, wherein an attachment opening is defined in a bottom end of the bottom overmold component, wherein the attachment opening includes a hollow cylinder having a second plurality of air pores, wherein a central handle opening, into which the handle is inserted, is defined through a center of the top overmold component, and wherein a third plurality of air pores are defined in the top overmold component surrounding the central handle opening, wherein the attachment opening is configured to matingly connect to a valve assembly of the vacuum retention system, and wherein the valve assembly includes a valve flange integrated with a surface of the vacuum retention system, wherein the valve flange includes a central opening connecting an external environment to an interior of the vacuum retention system, a valve body inserted into the central opening of the valve flange, wherein prongs extend downwardly from the valve body that are configured to clasp onto a retaining ring of the valve flange, thereby preventing the valve body from being pulled out of the valve flange, at least one sealing element connected to the valve body, preventing ingress of air into the interior of the vacuum retention system when the valve assembly is in a closed position, a diaphragm within an upper recess of the valve body, wherein the diaphragm is configured to limiting air flow through the valve assembly to a single direction, and a valve body insert within the upper recess of the valve body, above the diaphragm.

These and other aspects of the present invention will become apparent to those skilled in the art after a reading of the following description of the preferred embodiment when considered with the drawings, as they support the claimed invention.

DETAILED DESCRIPTION

Figure 1A:
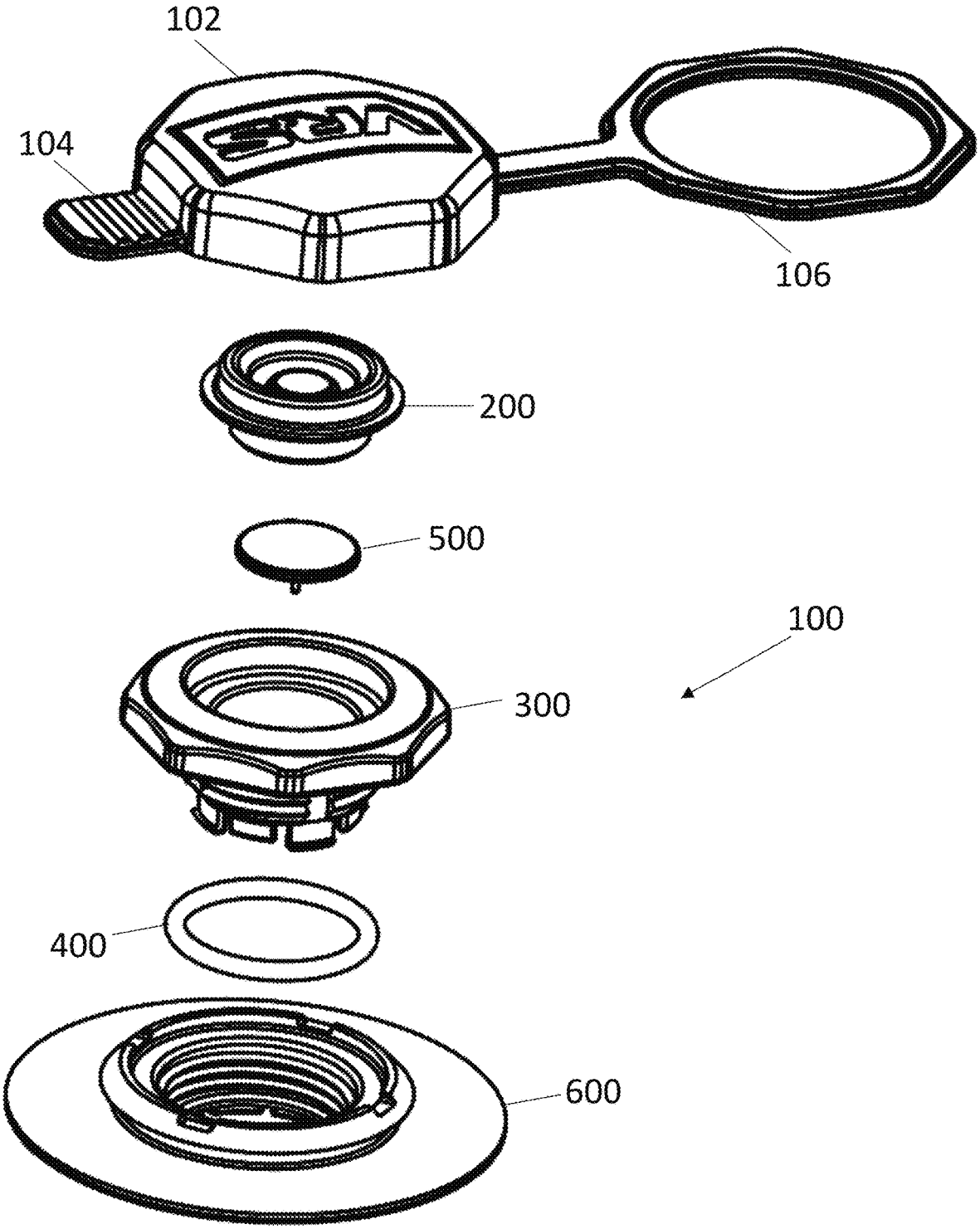
FIG. 1A illustrates an exploded view of a valve assembly for connection to a vacuum pump for evacuating air from a vacuum retention system according to one embodiment of the present invention.

The present invention is generally directed to pump and valve systems, and more specifically to pumps and valves configured to evacuate air from a vacuum retention system.

In one embodiment, the present invention is directed to a valve assembly for a vacuum retention system, including a valve flange integrated with a surface of the vacuum retention system, wherein the valve flange includes a central opening connecting an external environment to an interior of the vacuum retention system, a valve body inserted into the central opening of the valve flange, wherein prongs extend downwardly from the valve body that are configured to clasp onto a retaining ring of the valve flange, thereby preventing the valve body from being pulled out of the valve flange, at least one sealing element connected to the valve body, preventing ingress of air into the interior of the vacuum retention system when the valve assembly is in a closed position, a diaphragm within an upper recess of the valve body, wherein the diaphragm is configured to limiting air flow through the valve assembly to a single direction, and a valve body insert within the upper recess of the valve body, above the diaphragm.

In another embodiment, the present invention is directed to a vacuum pump assembly for withdrawing air from a vacuum retention system, including a hollow tube, wherein a plurality of tabs extending outwardly from an exterior surface of the hollow tube, a bottom overmold component including a first plurality of clasps each with openings configured to matingly engage with the plurality of tabs, a top overmold component including a second plurality of clasps each with openings configured to matingly engage with the plurality of tabs, an internal filter within the hollow tube including a first plurality of air pores, and a handle, wherein an attachment opening is defined in a bottom end of the bottom overmold component, wherein the attachment opening includes a hollow cylinder having a second plurality of air pores, wherein a central handle opening, into which the handle is inserted, is defined through a center of the top overmold component, and wherein a third plurality of air pores are defined in the top overmold component surrounding the central handle opening.

In yet another embodiment, the present invention is directed to a vacuum pump assembly for withdrawing air from a vacuum retention system, including a hollow tube, wherein a plurality of tabs extending outwardly from an exterior surface of the hollow tube, a bottom overmold component including a first plurality of clasps each with openings configured to matingly engage with the plurality of tabs, a top overmold component including a second plurality of clasps each with openings configured to matingly engage with the plurality of tabs, and a handle, wherein an attachment opening is defined in a bottom end of the bottom overmold component, wherein the attachment opening includes a hollow cylinder having a second plurality of air pores, wherein a central handle opening, into which the handle is inserted, is defined through a center of the top overmold component, and wherein a third plurality of air pores are defined in the top overmold component surrounding the central handle opening, wherein the attachment opening is configured to matingly connect to a valve assembly of the vacuum retention system, and wherein the valve assembly includes a valve flange integrated with a surface of the vacuum retention system, wherein the valve flange includes a central opening connecting an external environment to an interior of the vacuum retention system, a valve body inserted into the central opening of the valve flange, wherein prongs extend downwardly from the valve body that are configured to clasp onto a retaining ring of the valve flange, thereby preventing the valve body from being pulled out of the valve flange, at least one sealing element connected to the valve body, preventing ingress of air into the interior of the vacuum retention system when the valve assembly is in a closed position, a diaphragm within an upper recess of the valve body, wherein the diaphragm is configured to limiting air flow through the valve assembly to a single direction, and a valve body insert within the upper recess of the valve body, above the diaphragm.

Vacuum retention systems for use in cases, bags, or other containers for retaining various types of items (e.g., firearms, medical supplies, equipment, etc.) have been described in prior art documents such as U.S. patent application Ser. No. 18/625,791, which is incorporated herein by reference in its entirety. Such vacuum retention system includes a container (e.g., a bag) filled with small packaging materials (e.g., microbeads). When air is evacuated from the container, the small packaging materials compress and settle around items placed atop the container, thereby conforming to its shape and keeping it in place.

However, none of the prior art describes a valve system connected to the container specifically designed to ensure that the air is able to be withdrawn via a vacuum pump without leaking air when the valve is in a closed position. Furthermore, the prior art does not disclose a pump specifically designed to work in conjunction with such a valve system connected to the container for maximum effectiveness.

However, one of ordinary skill in the art will understand that while the valve and pump mechanisms of the present invention are discussed below with reference to a vacuum retention system, the valve and pump are able to instead be used with other systems as well in various fields, including medicine, shipping, consumer goods, and/or any other sectors.

Referring now to the drawings in general, the illustrations are for the purpose of describing one or more preferred embodiments of the invention and are not intended to limit the invention thereto.

Figure 1B:
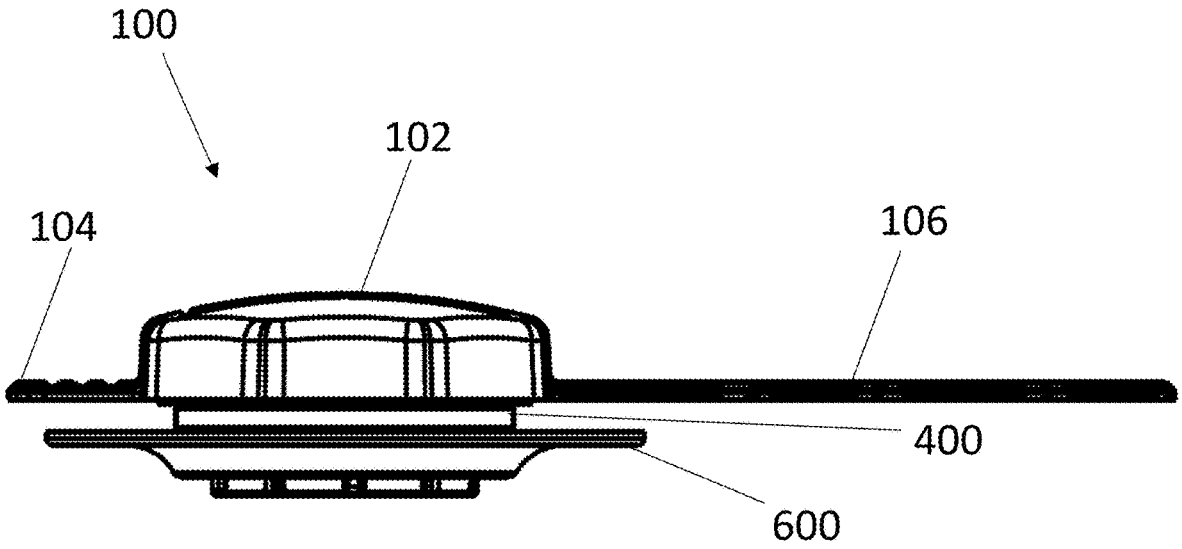
FIG. 1B illustrates a side view of a valve assembly for connection to a vacuum pump for evacuating air from a vacuum retention system according to one embodiment of the present invention.
Figure 1C:
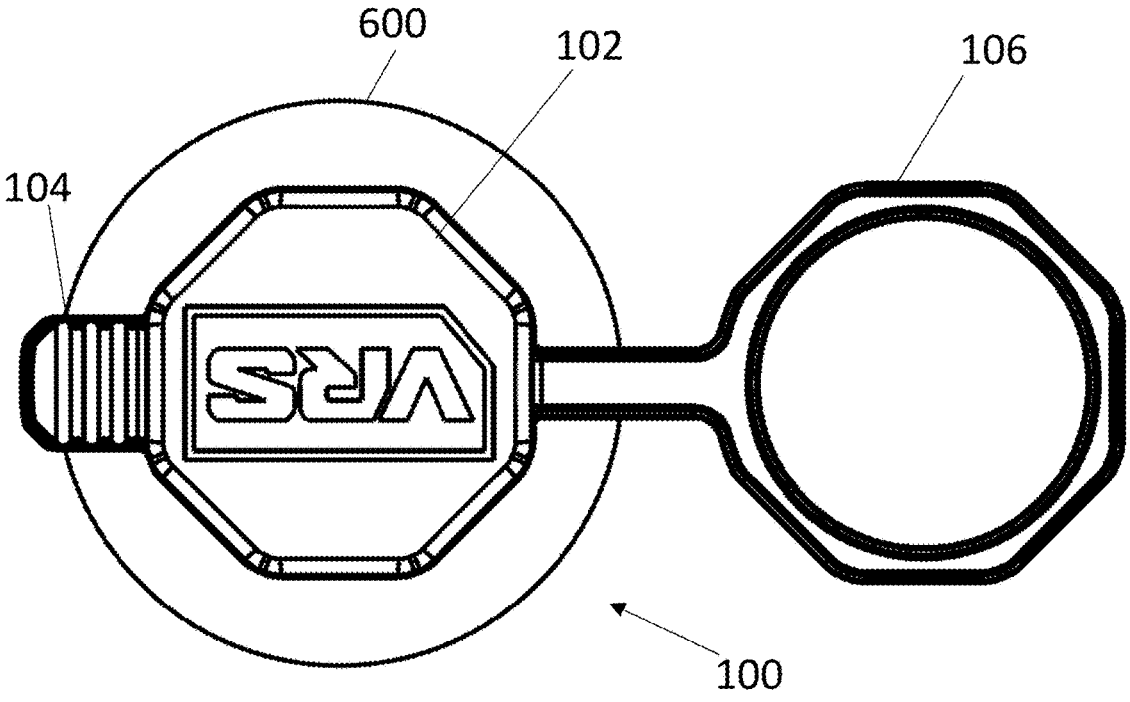
FIG. 1C illustrates a top view of a valve assembly for connection to a vacuum pump for evacuating air from a vacuum retention system according to one embodiment of the present invention.

FIGS. 1A-1C illustrate a valve assembly for connection to a vacuum pump for evacuating air from a vacuum retention system according to one embodiment of the present invention. The valve assembly 100 of the present invention is connected to a container of a vacuum retention system, allowing for evacuation of air from the container, while retaining microbeads within the container, when the valve is open, but retaining air within the container when the valve is closed. The valve assembly is configured to connect to at least one vacuum pump, which is discussed further with regard to FIGS. 7A-14D.

The valve assembly 100 includes the following components: a cap 102, a valve body insert 200, a valve body 300, a sealing element 400, a diaphragm 500, and a valve flange 600, wherein the valve flange 600 is directly connected and attached to the container (e.g., integrally formed, welded, or any other suitable attachment mechanism). In one embodiment, the components are arranged such that the diaphragm 500 is configured to fit into the valve body 300, with the valve body 300 inserted into the flange 600 (e.g., screwed into the flange 600 via threading). The sealing element 400 is disposed between the valve body 300 and the inner surface of the flange 600 hole to prevent leaking through the valve assembly 100. The valve body insert 200 is then inserted into a hole in the top of the valve body 300 over the diaphragm 500. Finally, the valve body 300 is topped with the cap 102. In one embodiment, the cap 102 includes an attachment ring 106 and/or a pull tab 104, which are able to be used to more easily pull off the cap 102 from the valve assembly.

In one embodiment, as shown in FIG. 1B, the length of the portion of the valve body 300 inserted into the hole of the flange 600 is greater than the depth of the flange 600 hole itself. This means that part of the inserted portion of the valve body 300 is visible above the flange 600. Alternatively, in another embodiment, the length of the portion of the valve body 300 inserted into the hole of the flange 600 is less than or approximately equal to the depth of the flange 600 hole itself. In one embodiment, the cap 102 is sized and configured such that it extends over and covers the top and a portion of the sides of the valve body 300, but when fully closed, does not extend to touching a top surface of the flange 600. In another embodiment, the cap 102 is sized and configured to extend over the valve body 300 such that the bottom of the cap 102 is flush with a top surface of the flange 600. In one embodiment, as shown in FIG. 1C, the radius of the cap 102 (or characteristic length in the case of non-circular caps) is greater than the radius of the valve body 300 but less than the radius of the flange 600, such that the flange 600 extends out beyond a main body of the cap 102. In another embodiment, the radius of the cap 102 is approximately equal to or greater than the radius of the flange 600. In one embodiment, a main body of the cap 102 is substantially regularly octagonal in cross-section. However, one of ordinary skill in the art will understand that cap main body shapes are also contemplated herein, including but not limited to circular, pentagonal, hexagonal, and/or elliptical in cross-section.

Figure 2A:
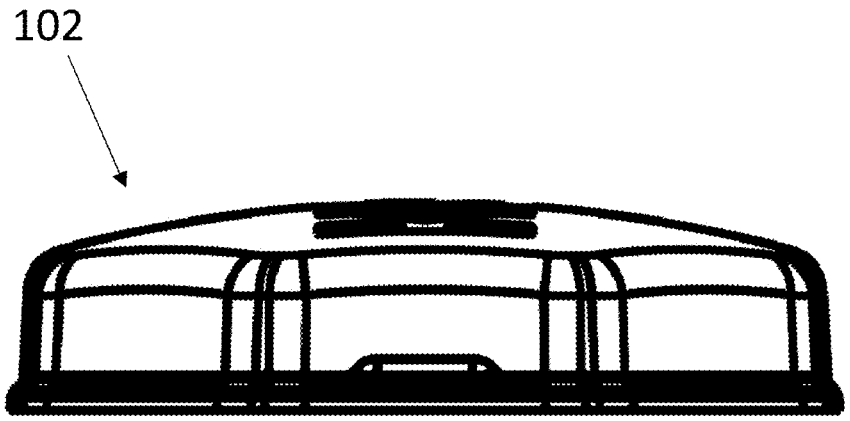
FIG. 2A illustrates a front view of a cap for a valve assembly for connection to a vacuum pump for evacuating air from a vacuum retention system according to one embodiment of the present invention.
Figure 2B:
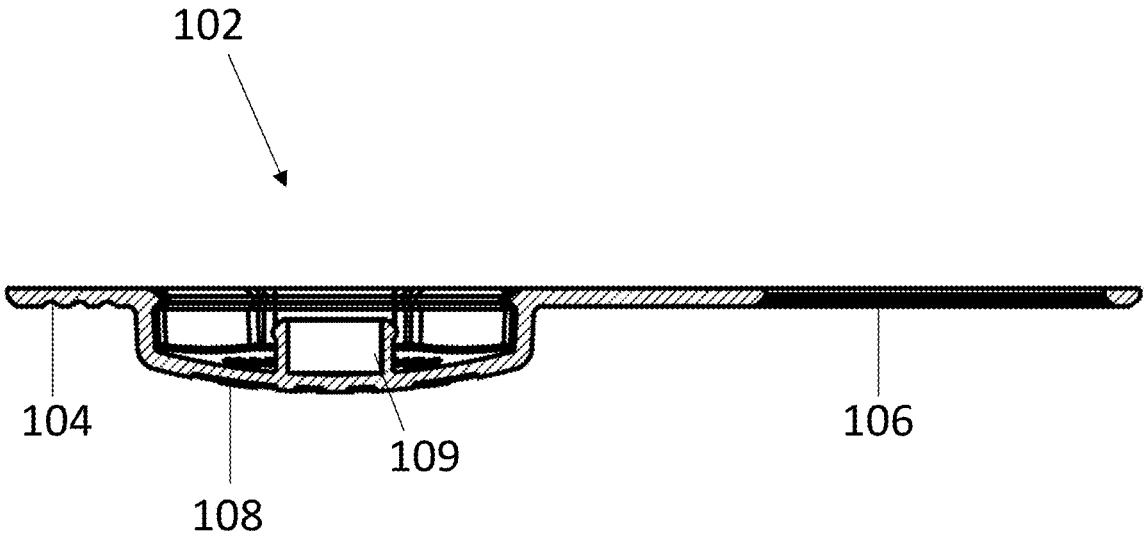
FIG. 2B illustrates a side view of a cap for a valve assembly for connection to a vacuum pump for evacuating air from a vacuum retention system according to one embodiment of the present invention.

FIGS. 2A-2B illustrate a cap for a valve assembly for connection to a vacuum pump for evacuating air from a vacuum retention system according to one embodiment of the present invention. In one embodiment, the tab 104 and the attachment ring 106 of the cap 102 extend outwardly from a main body 108. In the embodiment shown in FIGS. 2A-2B, the tab 104 and the attachment ring 106 extend from opposite sides of the main body 108 of the cap 102. However, one of ordinary skill in the art will understand that the tab 104 and the attachment ring 106 do not need to extend from opposite sides and are able to, instead, extend at an angle relative to one another (e.g., a 60 degree angle between the two components). The attachment ring 106 includes a hollow circular portion configured to be fitted around a raised portion of the valve flange, such that the attachment ring 106 is held between the valve flange and the valve body when the parts are connected. Because the valve body is retained on the valve flange, this prevents the cap 102 from being fully disconnected from the valve assembly during use, thereby preventing the cap 102 from being lost. The tab 104 is configured to be pressed (e.g., via a user's fingers or via another instrument) to cause the cap 102 to pop up upward for easier removal.

The main body 108 of the cap is preferably substantially hollow with an extension 109 (e.g., a hollow cylindrical, or otherwise shaped, extension) extension downwardly from a top surface of the hollow interior. This extension 109 is sized and shaped to engage with a projection extending upwardly from a valve body insert, as discussed further below.

FIGS. 3A-3E illustrate a valve body insert according to one embodiment of the present invention. In one embodiment, the valve body includes a central projection 202 surrounded by an outer rim 204. In one embodiment, the central projection 202 and the outer rim 204 are concentric. In one embodiment, the central projection 202 and the outer rim 204 have substantially circular cross-sections, though one of ordinary skill in the art will understand that other shapes are also contemplated herein. The central projection 202 preferably extends outwardly from a bottom surface of a recess of the valve body insert 200. The central projection 202 defines a central bore through which air is able to pass.

In one embodiment, the outer rim 204 includes an annular shoulder 207 that extends outwardly from the outer rim 204, such that the top of the annular shoulder 207 extends further outwardly relative to the central projection 202. A gap 208 is defined between the central projection 202 and the annular shoulder 207. A base 205 extends downwardly from the outer rim 204 and, in one embodiment, the base 205 has a substantially circular cross-section that is concentric with the outer rim 204. The base 205 is substantially hollow, thereby defining the recess with the bottom surface from which the central projection 202 extends. The central bore of the central projection 202 also extends through the bottom surface of the base 205 as well.

Figure 3A:
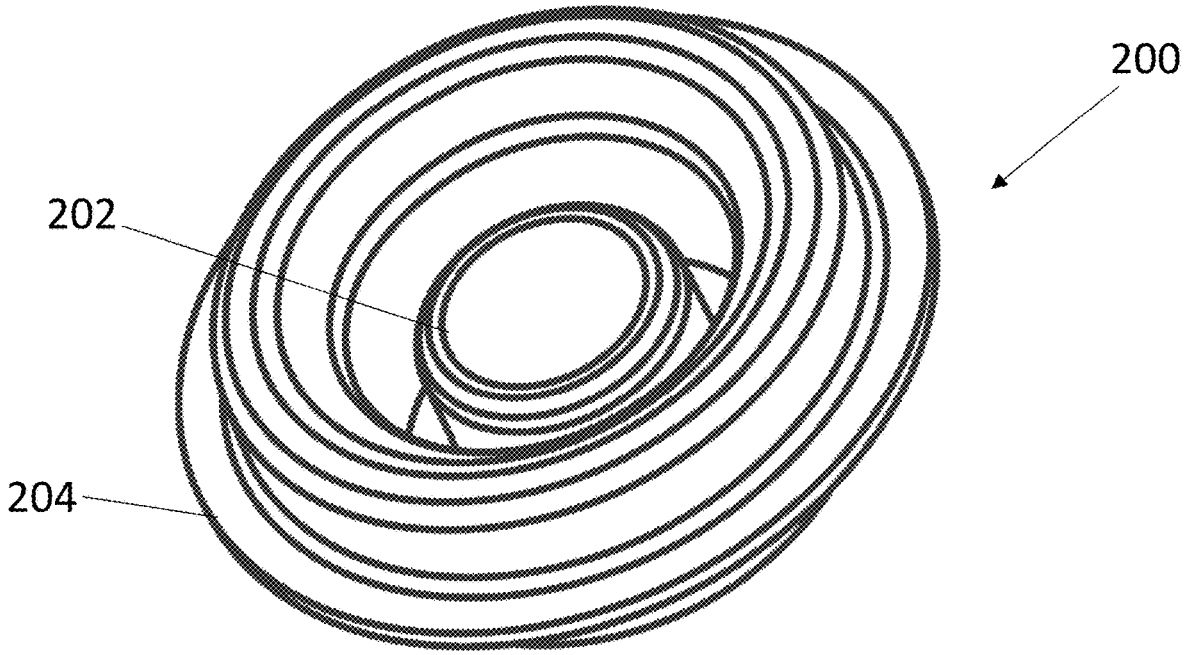
FIG. 3A illustrates a perspective view of a valve body insert according to one embodiment of the present invention.
Figure 3B:
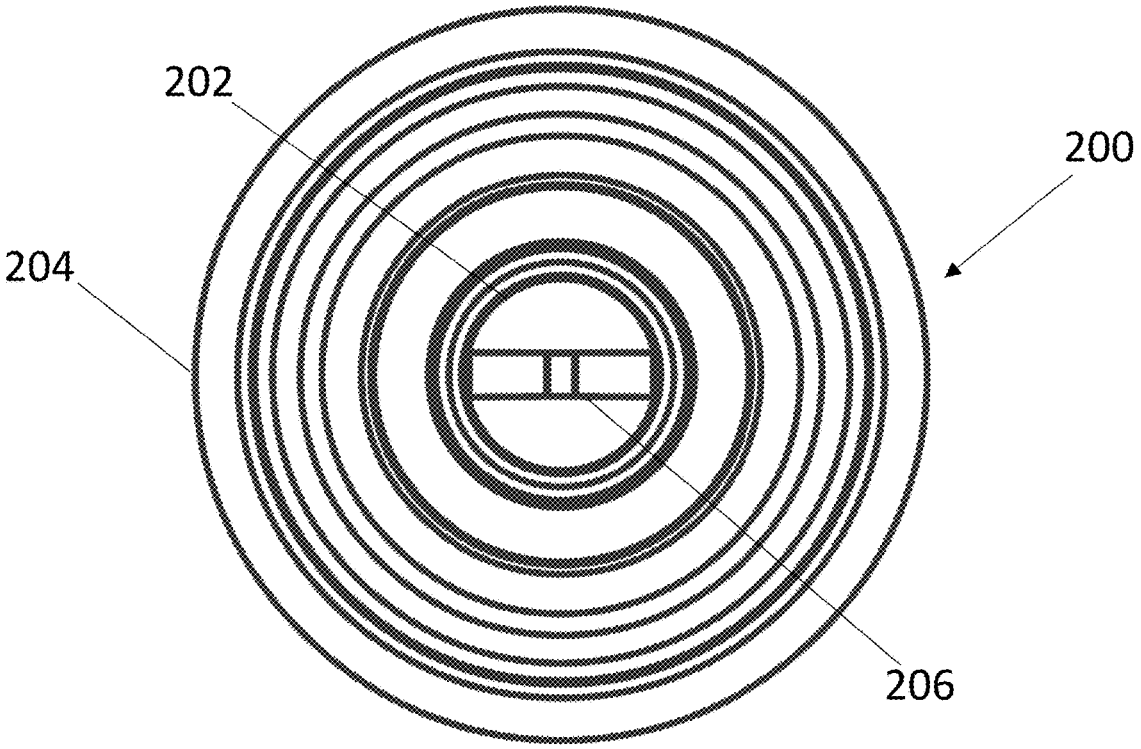
FIG. 3B illustrates a bottom view of a valve body insert according to one embodiment of the present invention.
Figure 3C:
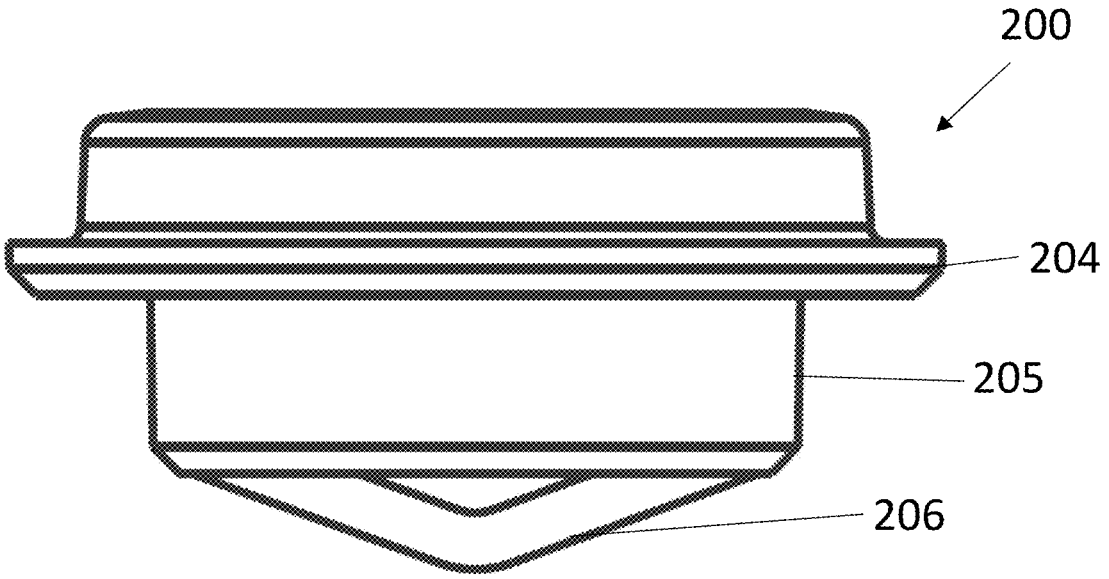
FIG. 3C illustrates a front view of a valve body insert according to one embodiment of the present invention.
Figure 3D:
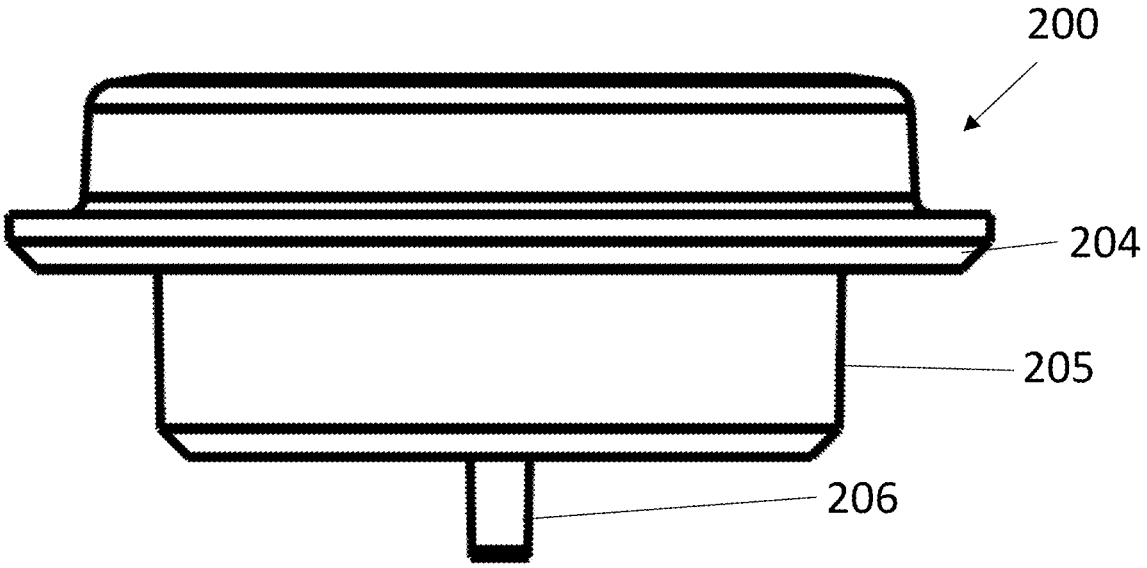
FIG. 3D illustrates a side view of a valve body insert according to one embodiment of the present invention.
Figure 3E:
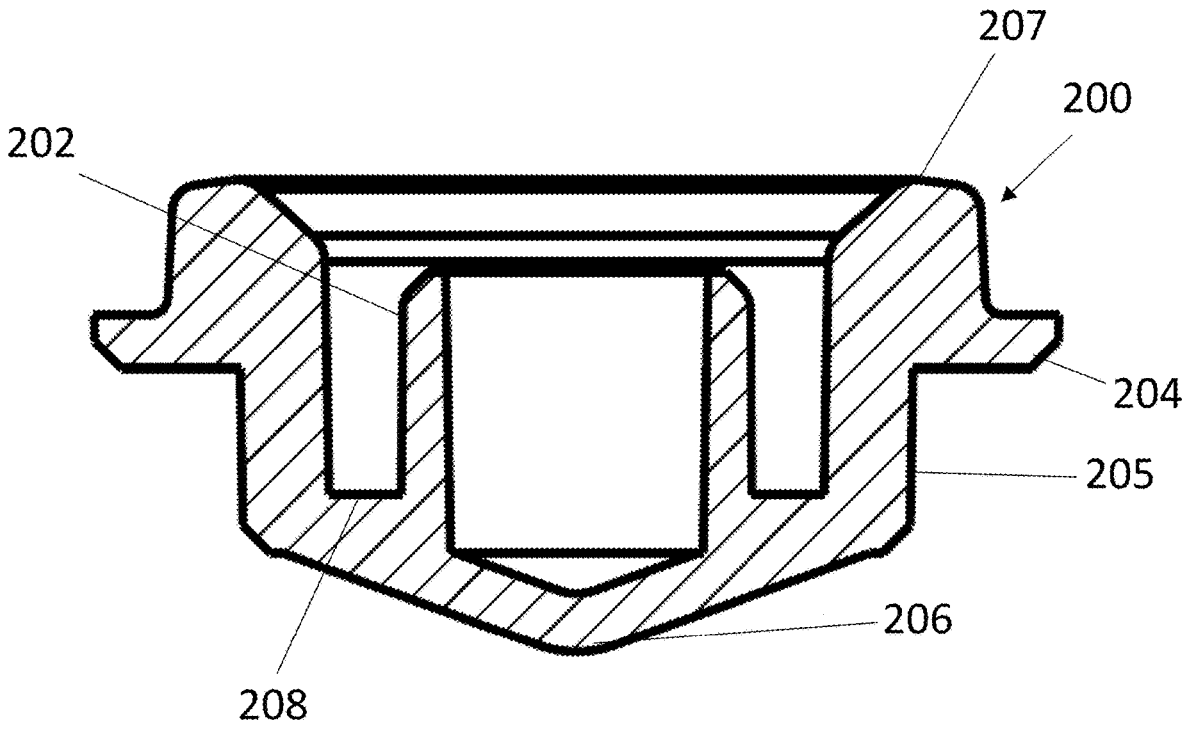
FIG. 3E illustrates a side sectional view of a valve body insert according to one embodiment of the present invention.
Figure 4A:
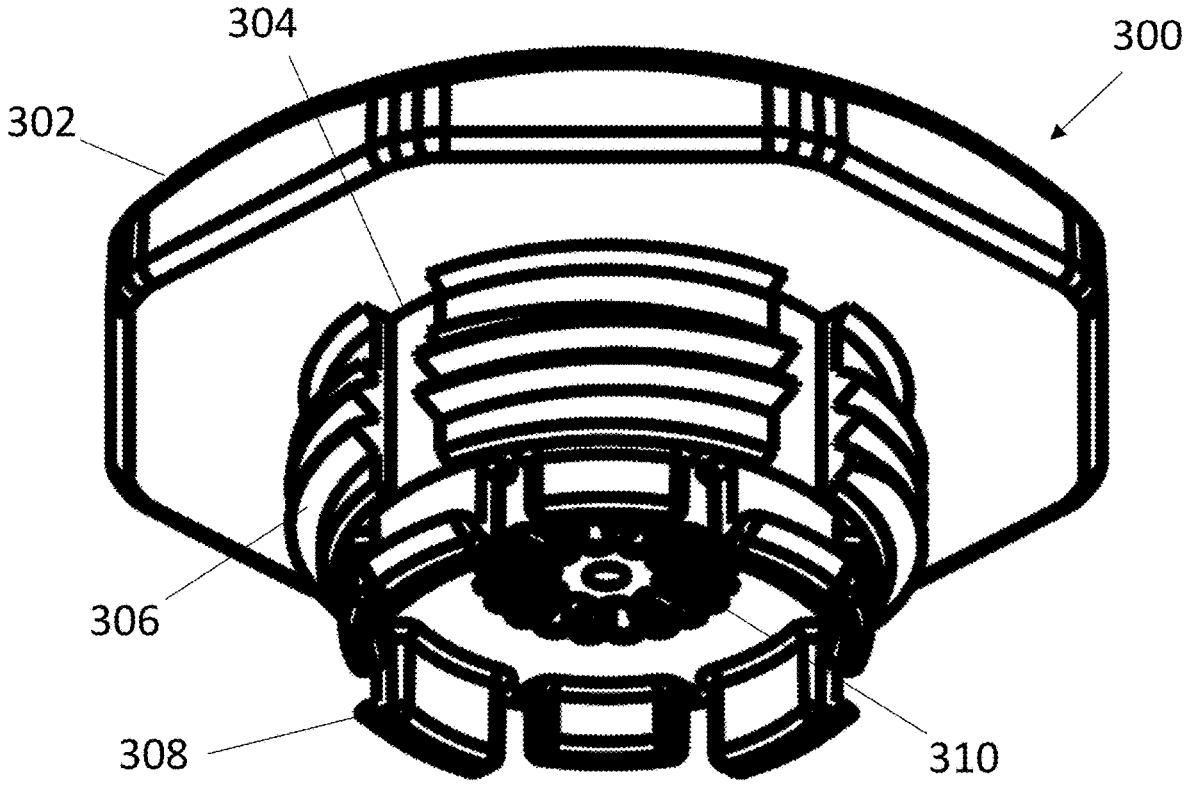
FIG. 4A illustrates a bottom perspective view of a valve body according to one embodiment of the present invention.
Figure 4B:
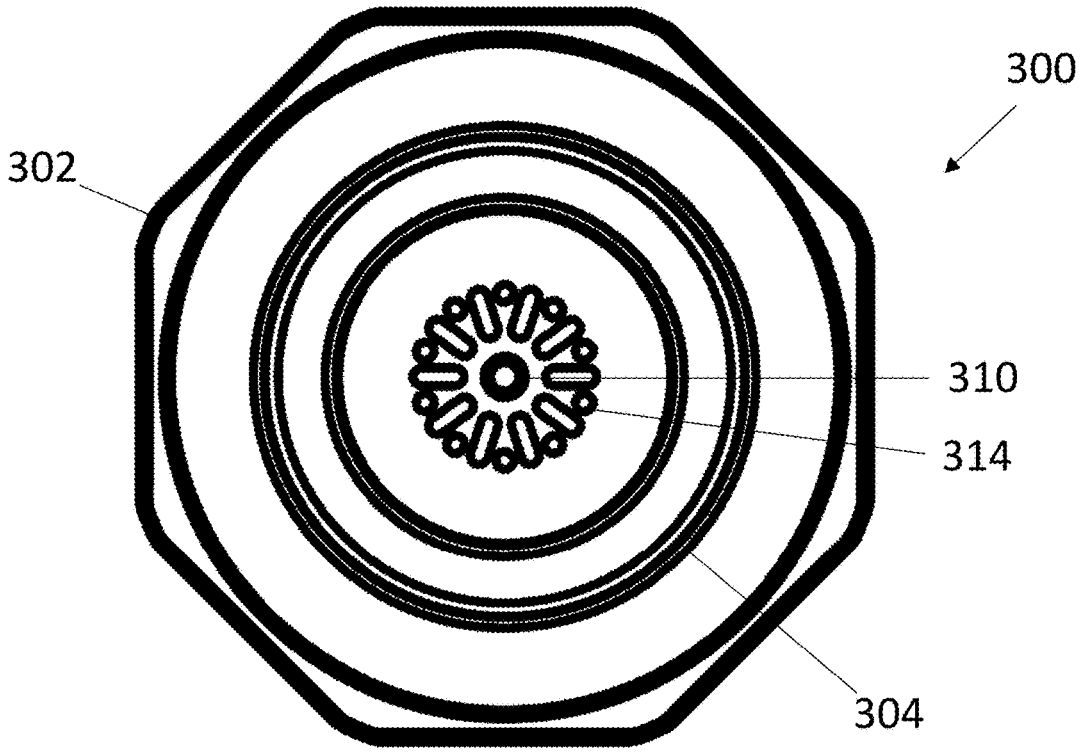
FIG. 4B illustrates a bottom orthogonal view of a valve body according to one embodiment of the present invention.
Figure 4C:
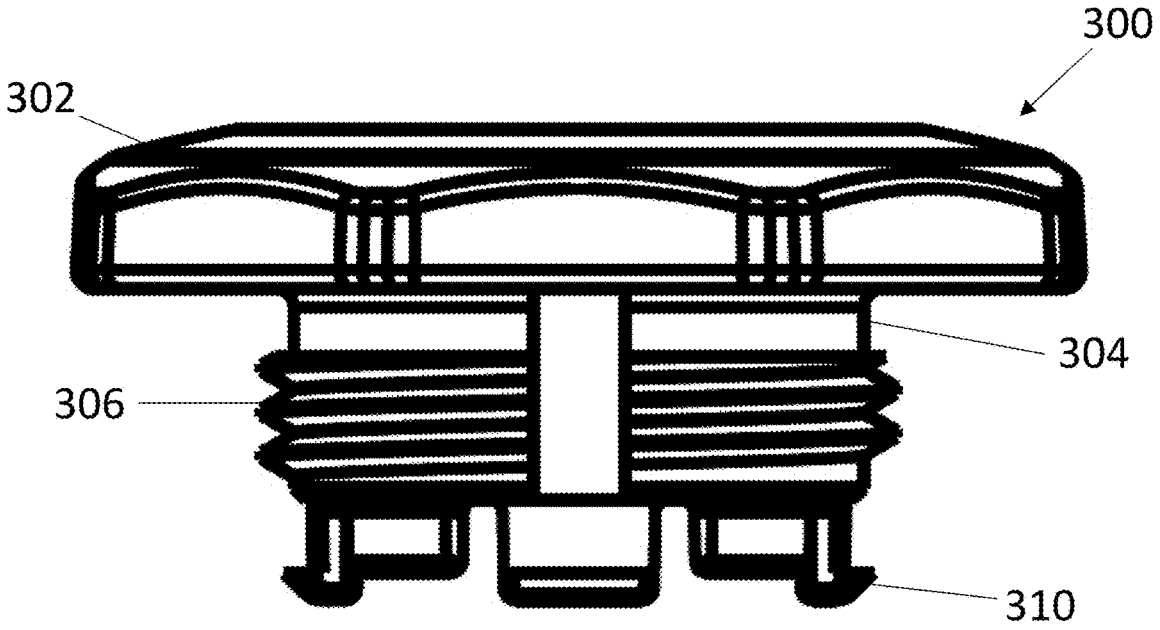
FIG. 4C illustrates a side view of a valve body according to one embodiment of the present invention.
Figure 4D:
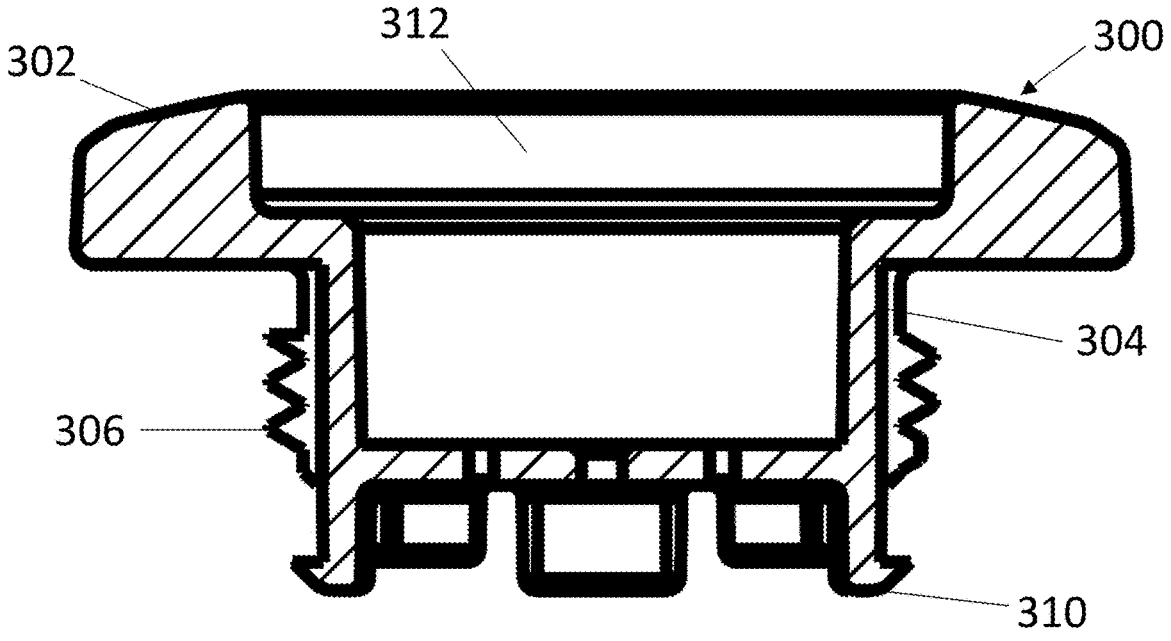
FIG. 4D illustrates a side sectional view of a valve body according to one embodiment of the present invention.

A support 206 extend downwardly from a bottom of the base 205. The support 206 includes portions extending from opposite edges of the base 205, with the portions extending at an angle (i.e., between a zero and 90 degree angle), such that the support 206 defines a substantially triangular cross-section. In one embodiment, as shown in FIG. 3C, the center of the support 206 is separated by a small gap from the bottom of the base 205. In one embodiment, the support 206 is formed from a flexible material (e.g., a rubber, a soft polymer, etc.) such that the support 206 is able to deform with applied pressure. In one embodiment, the valve body insert 200 is generally formed from a deformable and soft material (e.g., a rubber, a soft polymer, etc.) to allow the valve body insert 200 to be deflect and conform to the specific geometry of the valve body and/or the cap as needed to tightly connect the components.

The extension of the cap is sized and shaped to fit around the central projection 202 extending upwardly from the valve body insert 200, thereby more firmly securing the cap to the valve body insert 200. In one embodiment, this extension is configured to fit into the gap 208 defined between the central projection 202 and the annular shoulder 207.

FIGS. 4A-4D illustrate a valve body according to one embodiment of the present invention. The valve body 300 includes a top head portion 302 from which a lower neck portion 304 extends downwardly. In one embodiment, the lower neck portion 304 is substantially concentric with the top head portion 302, with the lower neck portion 304 having a smaller radius (or characteristic length) than the top head portion 302. In one embodiment, the top head portion 302 has a substantially octagonal cross section, but one of ordinary skill in the art will understand that other shapes are also contemplated herein, including but not limited to circular, hexagonal, square, or other shapes. In one embodiment, the lower neck portion 304 is substantially circular in cross section, but one of ordinary skill in the art will understand that other shapes are also contemplated herein, including but not limited to octagonal, hexagonal, square, or other shapes.

The upper head portion 302 defines a central opening 312 into which the valve body insert 200 is able to be inserted. The lower neck portion 304 is substantially hollow with the hollow interior chamber being open to and formed a common recess with the central opening 312 of the upper head portion 302. In one embodiment, as shown in FIG. 3A, an outer surface of the lower neck portion 304 is threaded 306 such that it is able to be inserted into and connected with the valve flange. In one embodiment, the sealing element is able to be placed around a portion of the threading 306 so as to improve the tight seal between the outer edges of the valve body 300 and the valve flange when the assembly is constructed. In one embodiment, a plurality of tabs 310 extend downwardly from an outer rim of the lower neck portion 304 to further assist in connection with the valve flange. A small hole 310 is defined through a center of the bottom surface of the lower neck portion 304, through which a needle of a diaphragm is able to be inserted. A plurality of secondary holes 314 surround the small hole 310, with air able to flow upwardly when a vacuum is applied, though which are blocked by the diaphragm to prevent air from flowing back into the container.

The upper head portion 302 is sized and shaped to fit the cap 102, such that the cap 102 surrounds and is in tight frictional engagement with the outer surface of the upper head portion 302 when placed on it.

In order to release the valve and allow airflow back into the container, the valve body 300 is able to be twisted relative to the valve flange. When this occurs, the threads 306 shift positions, causing pressure to be released from the sealing element around the threads 306, thereby allowing air to slip through between the valve body 300 and the valve flange and flow into the container. The plurality of tabs 310 are configured to deflect on a retaining ring on the valve flange and prevent the valve body 300 from being removed from the valve flange after the valve assembly is constructed.

In one embodiment, the valve body 300 is formed from a rigid or semi-rigid material, such as a metal (e.g., iron, aluminum, cobalt, etc.) or from a firm polymer (e.g., polypropylene, polycarbonate, polyethylene, such as high-density polyethylene (HDPE) or ultra-high molecular weight polyethylene (UHMWPE)). In one embodiment, the tabs are formed from a semi-rigid material and are configured to be able to deflect inwardly when the valve body 300 is inserted into the flange.

Figure 5A:
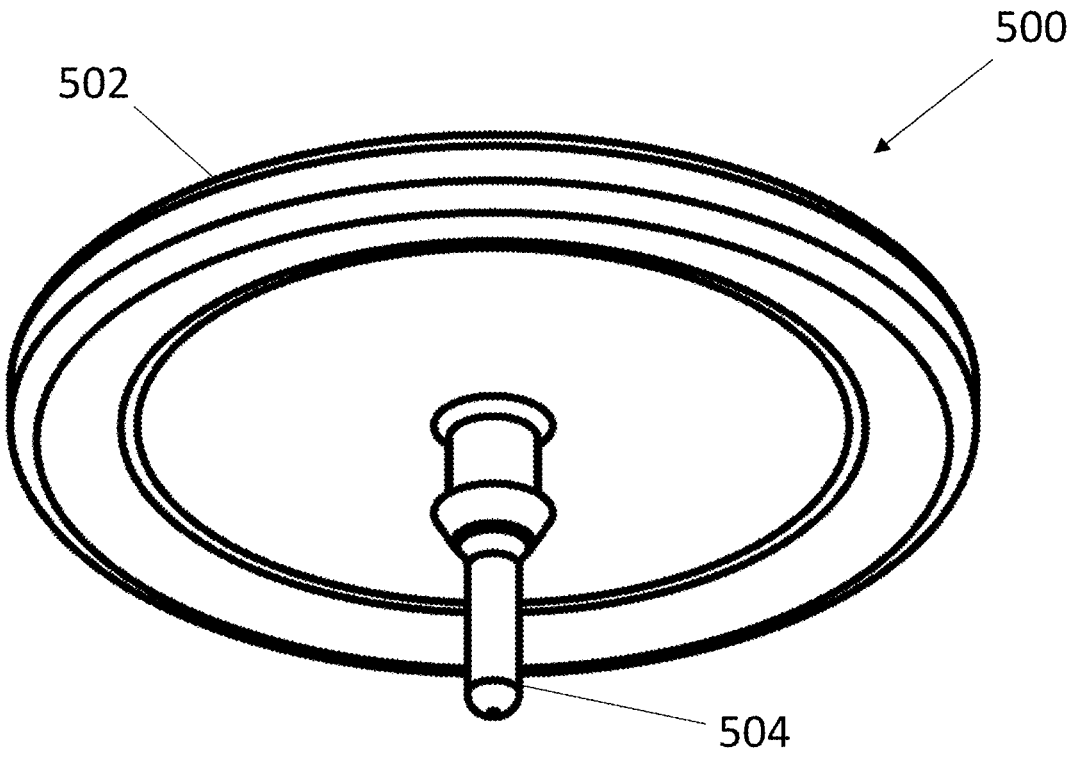
FIG. 5A illustrates a bottom perspective view of a valve diaphragm according to one embodiment of the present invention.
Figure 5B:
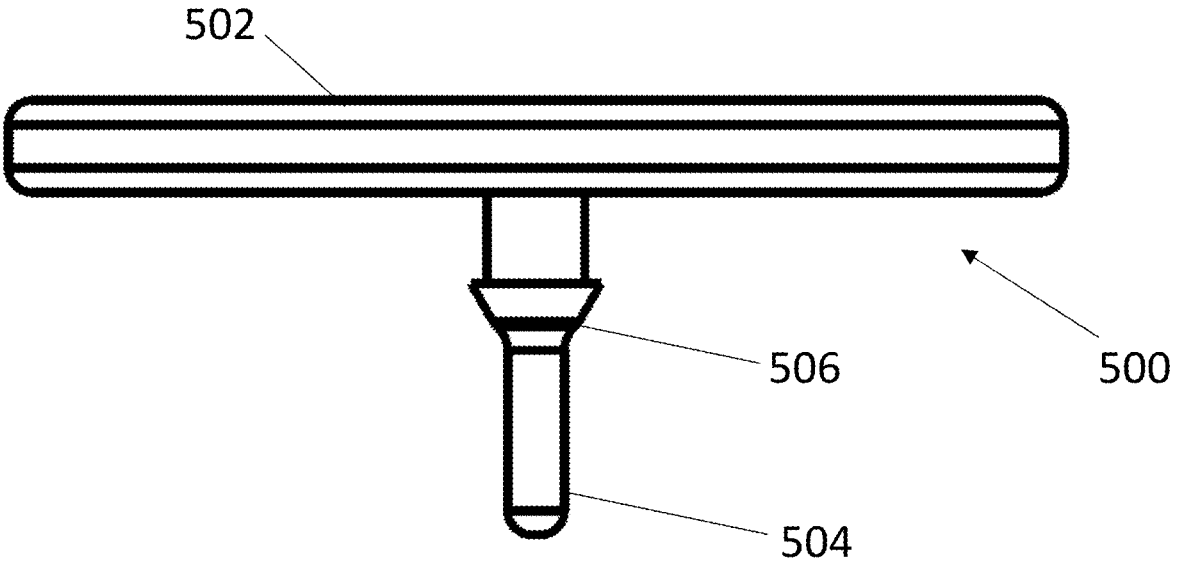
FIG. 5B illustrates a side view of a valve diaphragm according to one embodiment of the present invention.
Figure 6A:
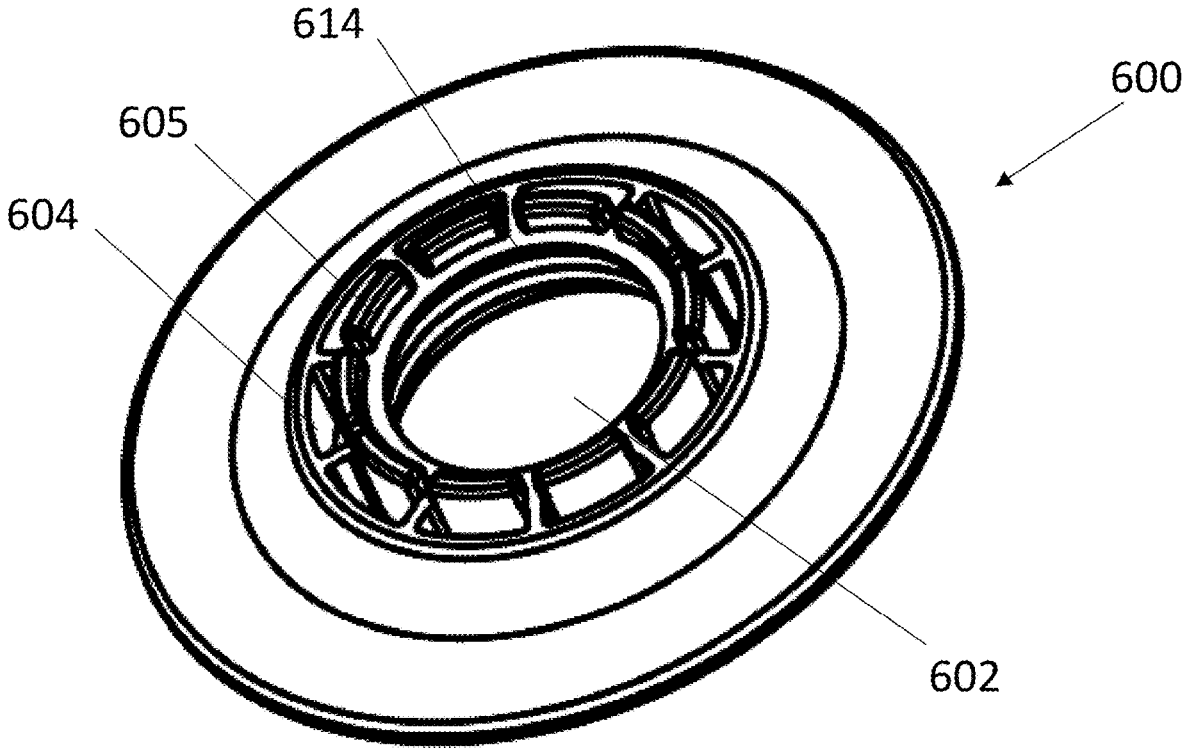
FIG. 6A illustrates a perspective view of a valve flange according to one embodiment of the present invention.
Figure 6B:
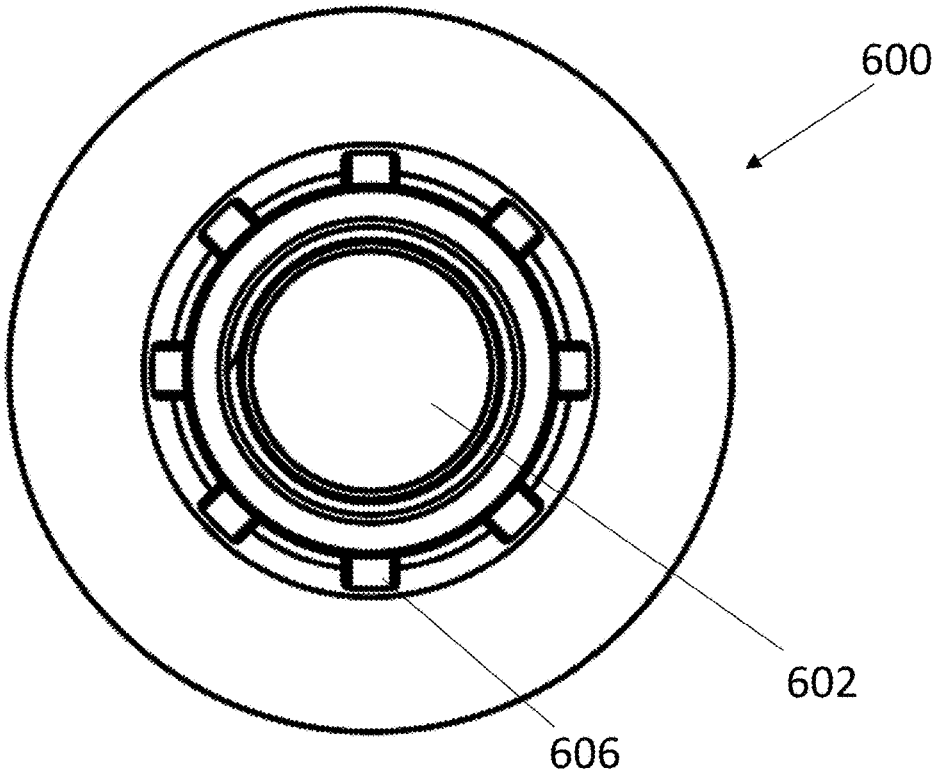
FIG. 6B illustrates a bottom view of a valve flange according to one embodiment of the present invention.
Figure 6C:
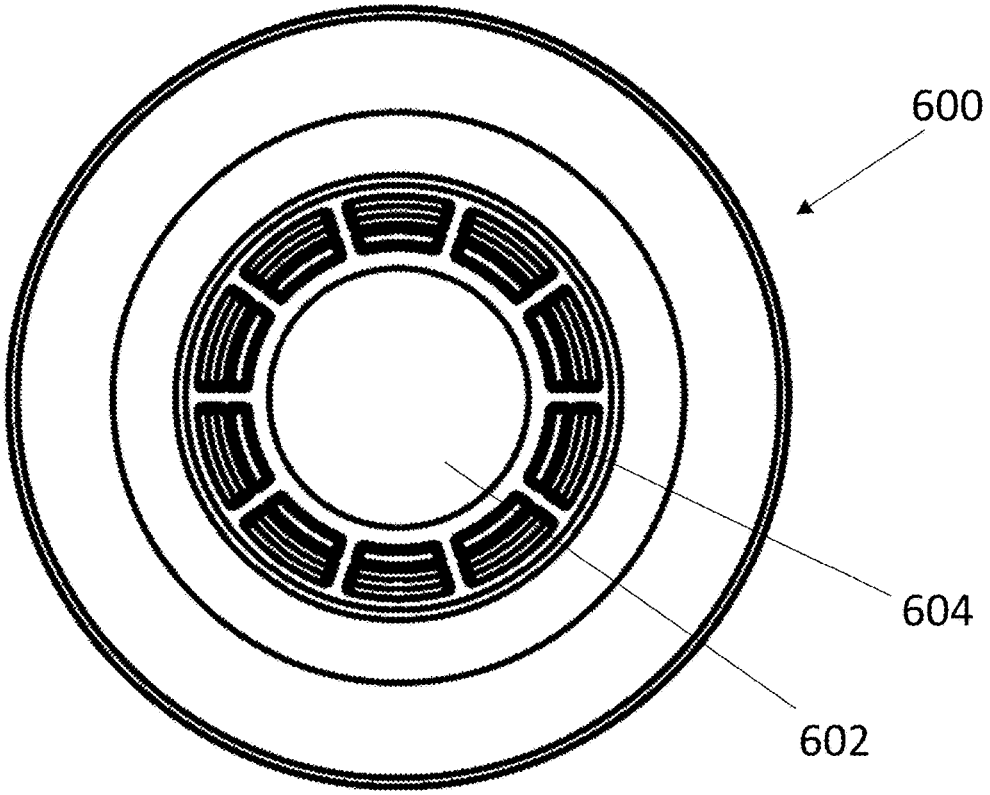
FIG. 6C illustrates a top view of a valve flange according to one embodiment of the present invention.
Figure 6D:
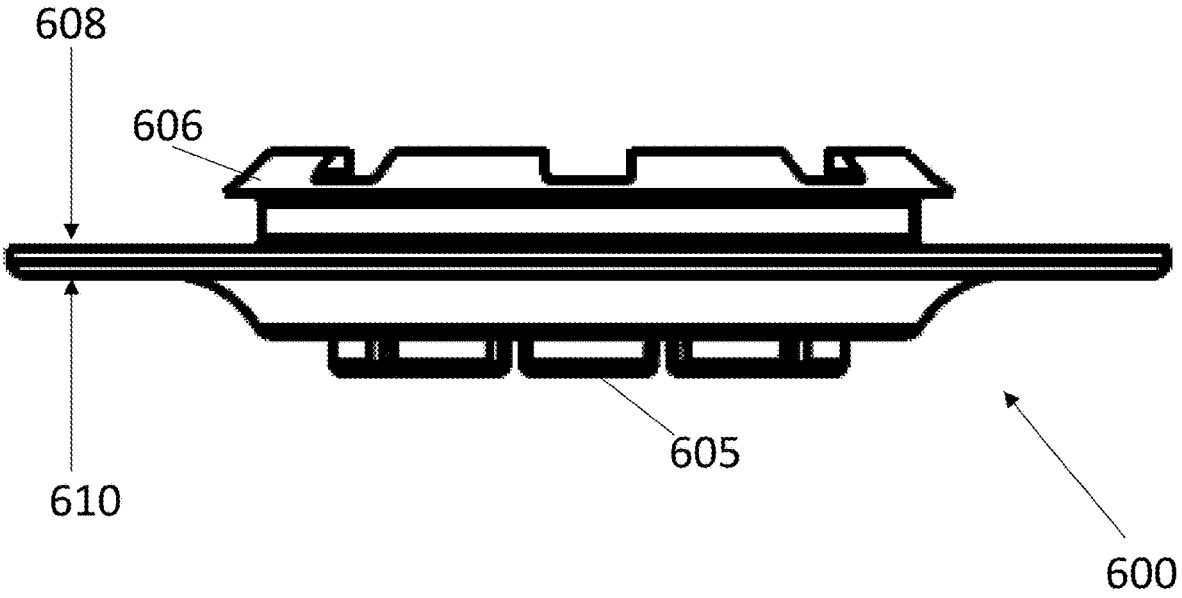
FIG. 6D illustrates a side view of a valve flange according to one embodiment of the present invention.
Figure 6E:
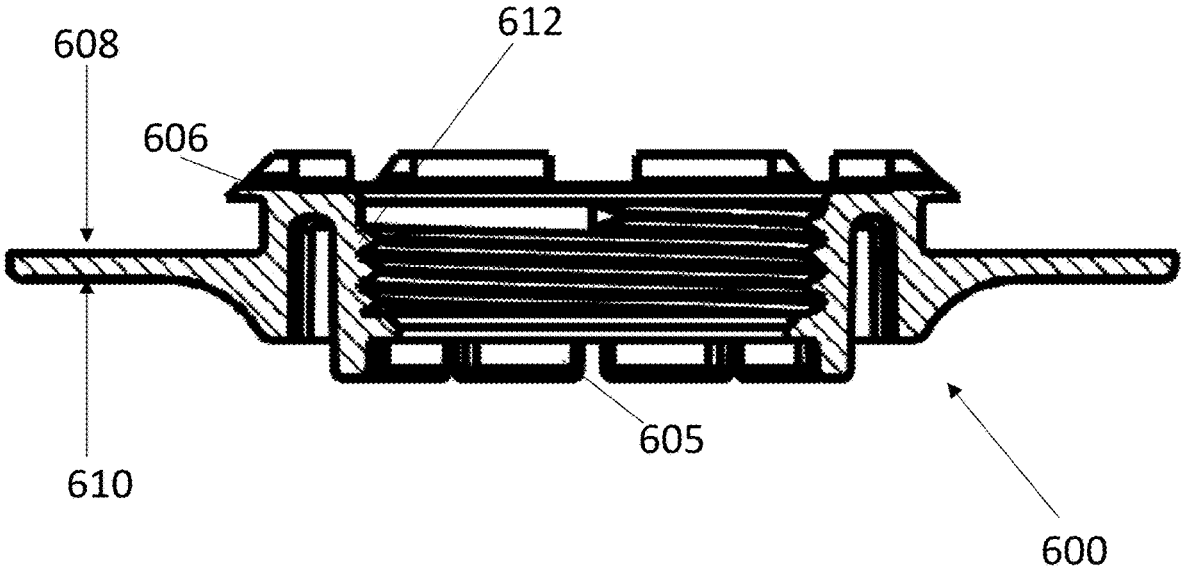
FIG. 6E illustrates a side sectional view of a valve flange according to one embodiment of the present invention.

FIGS. 5A-5B illustrate a valve diaphragm according to one embodiment of the present invention. In one embodiment, the valve diaphragm 500 includes an upper rim 502 having a bottom surface from which a needle 504 extends downwardly. In one embodiment, the needle 504 extends downwardly from a location substantially in the center of the upper rim 502. In one embodiment, the upper rim 502 is substantially circular in cross-section, though one of ordinary skill in the art will understand that other shapes, including but not limited to octagonal, hexagonal, square, or other, are also contemplated herein.

The needle 504 is configured to be inserted into the small hole defined in the bottom surface of the neck portion of the valve body. The needle 504 includes a shoulder 506 that is able to deflect when the needle 504 is inserted into the hole of the valve body, but which prevents the needle 504 from being removed or dislodged from the small hole even when vacuum pressure is applied. When positive pressure is applied to the top of the diaphragm, or in the absence of any vacuum pressure, the upper rim 502 of the diaphragm 500 blocks airflow through the plurality of secondary holes. However, when vacuum pressure is applied, the upper rim 502 is lifted off the plurality of secondary holes, thereby allowing airflow out of the container, while airflow into the container is restricted.

Preferably the diaphragm 500 is formed from a flexible rubber or polymer material to allow the diaphragm 500 to deform to allow airflow when vacuum pressure is applied.

FIGS. 6A-6E illustrate a valve flange according to one embodiment of the present invention. A valve flange 600 is attached to a container of a vacuum retention system (e.g., via welding, being integrally formed with the container, and/or other attachment means). A top surface 608 of the valve flange 600 is exposed to an exterior of the container, while a bottom surface 610 of the valve flange 600 is exposed to the interior of the container, meaning the valve flange 600 is integrated into the container wall.

The exterior side of the valve flange 600 includes a raised portion 606 configured to connect to a vacuum pump. In one embodiment, raised portion 606 includes a portion of prongs with lips configured to hold the vacuum pump in place until it is disengaged. A central bore 602 extends through a center of the raised portion 606 through the full thickness of the valve flange 600. In one embodiment, the central bore 602 includes internal threading 612, allowing for connection with the threading on the exterior surface of the lower neck portion of the valve body.

In one embodiment, on the interior side of the valve flange 600, a plurality of tabs 605 extending downwardly around the circumference of the central bore 602. In one embodiment, surrounding the plurality of tabs 605, the interior side includes a plurality of recesses 604. However, the plurality of recesses 604 do not define openings in the valve flange 600, as they do not extend through the full thickness of the valve flange 600.

A retaining ring 614 is positioned proximate to the interior side of the valve flange 600 and has a smaller radius than the rest of the central bore 602. When the valve body is inserted into the central bore 602, the tabs at the bottom of the valve body are able to deflect on the retaining ring 614, but the retaining ring 614 prevents the valve body from being removed from the valve flange 600. When in a sealed configuration, the tabs extend slightly beyond the retaining ring 614, thereby allowing the valve body to be rotated and moved to some extend (i.e., until the tabs catch on the retaining ring 614) in order to move the valve to an unsealed configuration. In an alternative embodiment, the valve body does not include tabs and is able to be fully removed from the valve flange 600. However, in this embodiment, the interior side of the central bore 602 is covered with at least one screen to prevent the outflow of materials from the interior of the vacuum retention system (e.g., microbeads). In one embodiment, the valve body includes the tabs to retain the valve body within the valve flange 600 and a screen is also included over the interior side of the central bore 602.

Figure 7A:
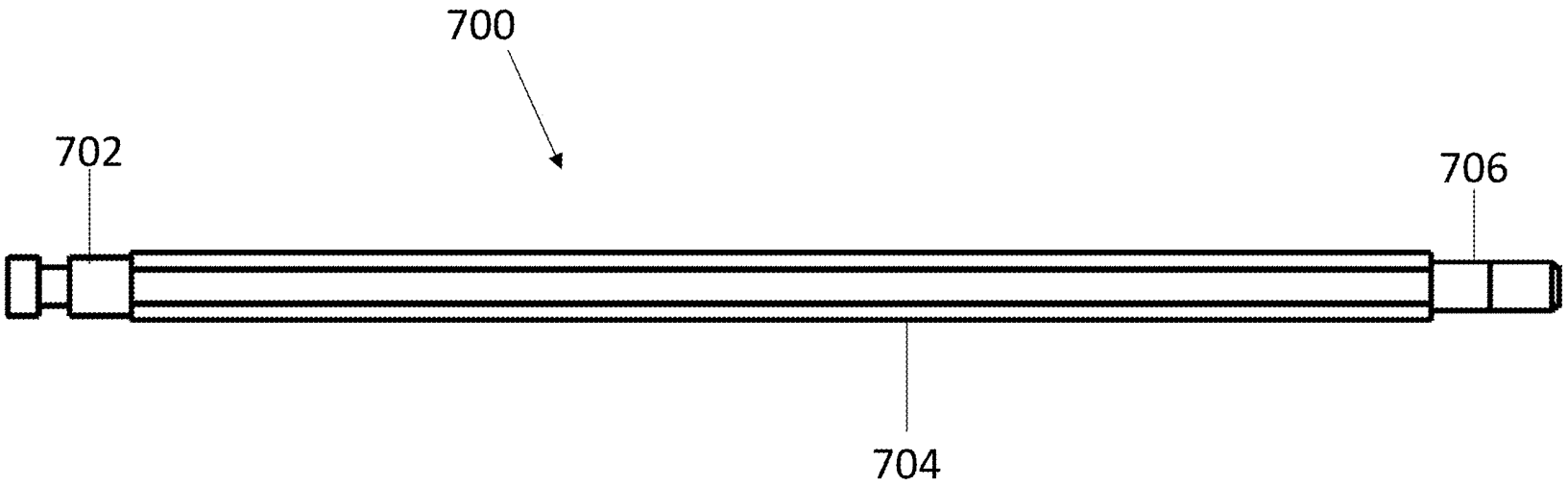
FIG. 7A illustrates a side view of a vacuum pump assembly for evacuating air from a vacuum retention system according to one embodiment of the present invention.
Figure 7B:
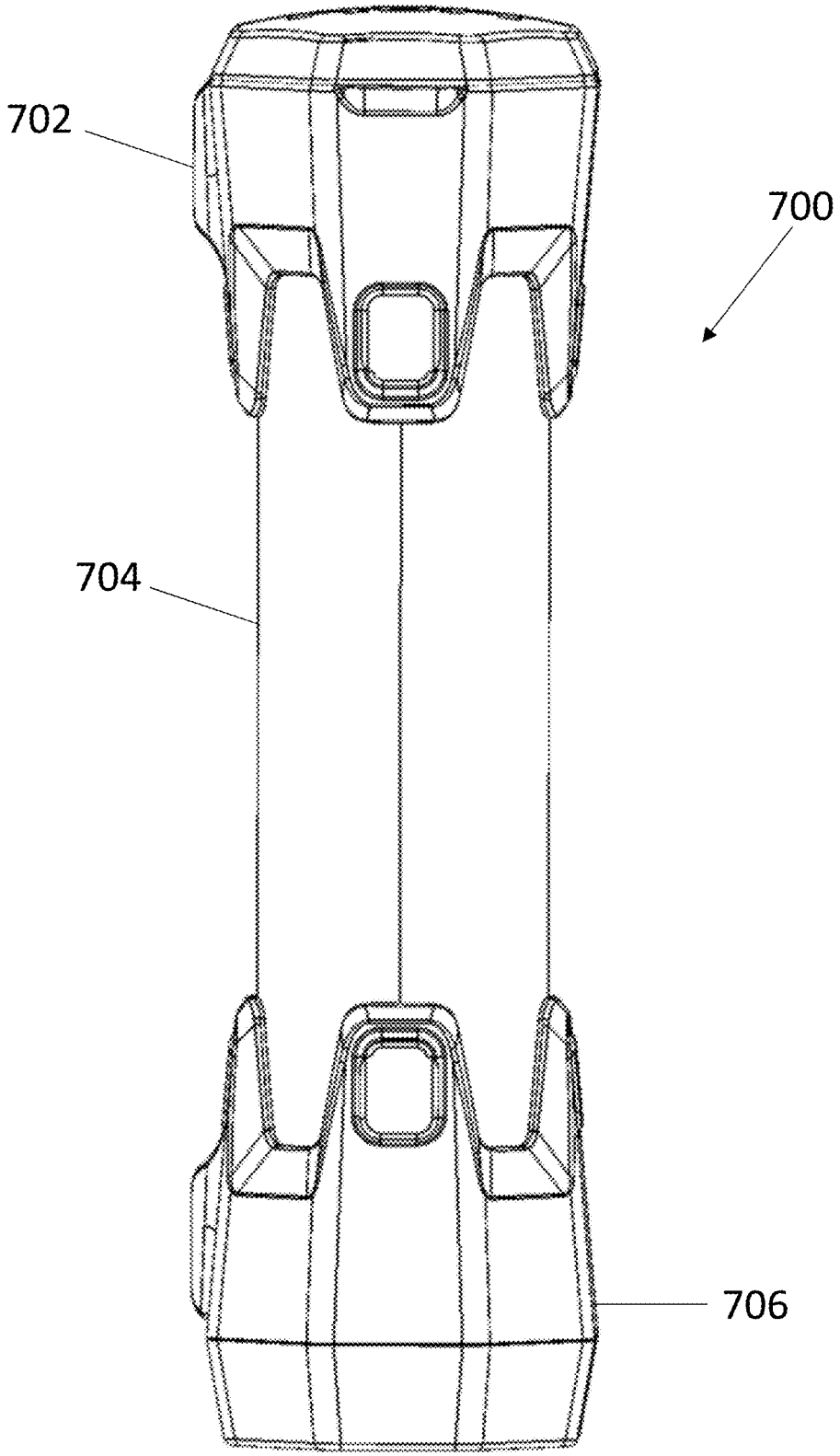
FIG. 7B illustrates a side view of a vacuum pump assembly for evacuating air from a vacuum retention system according to one embodiment of the present invention.

FIGS. 7A-7B illustrate a vacuum pump assembly for evacuating air from a vacuum retention system according to one embodiment of the present invention. The vacuum pump assembly 700 of the present invention is configured to attach to the valve assembly described with respect to FIGS. 1A-6E above to evacuate air from the container of the vacuum retention system through the valve assembly. As a broad overview, the vacuum pump assembly 700 includes a central tube 704, capped at a first end by a bottom overmold component 702 and at a second end by a top overmold component 706.

Figure 8A:
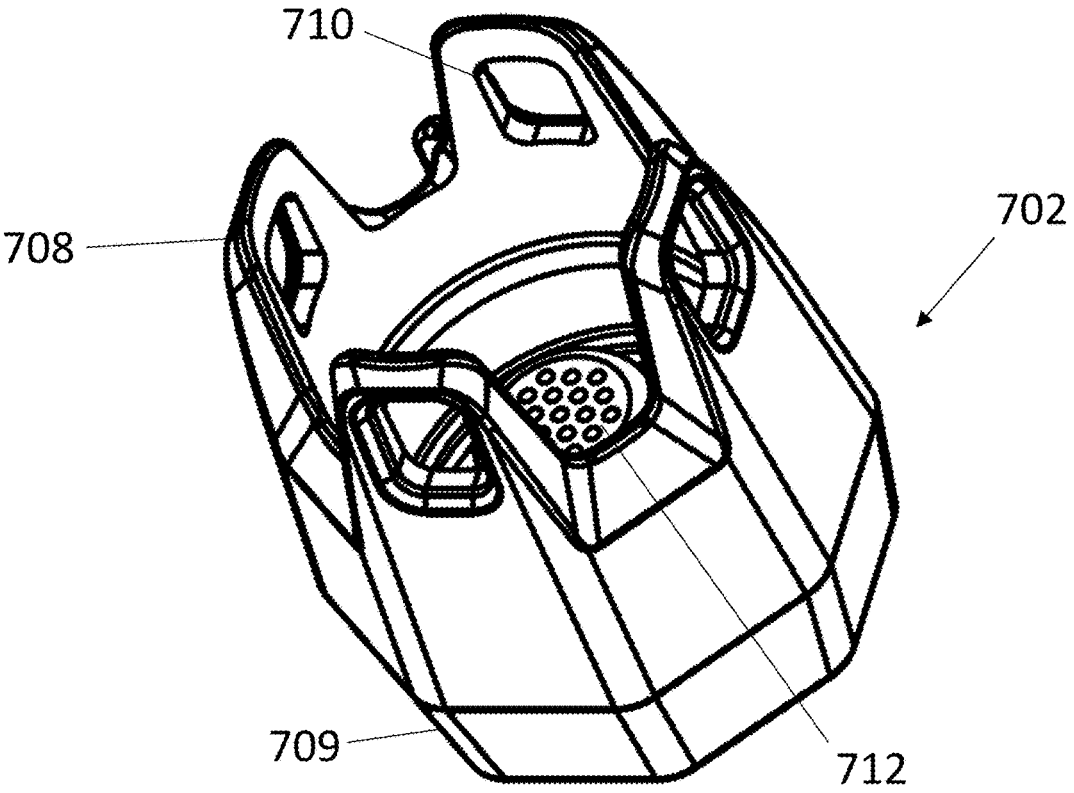
FIG. 8A illustrates a perspective view of a bottom pump overmold according to one embodiment of the present invention.
Figure 8B:
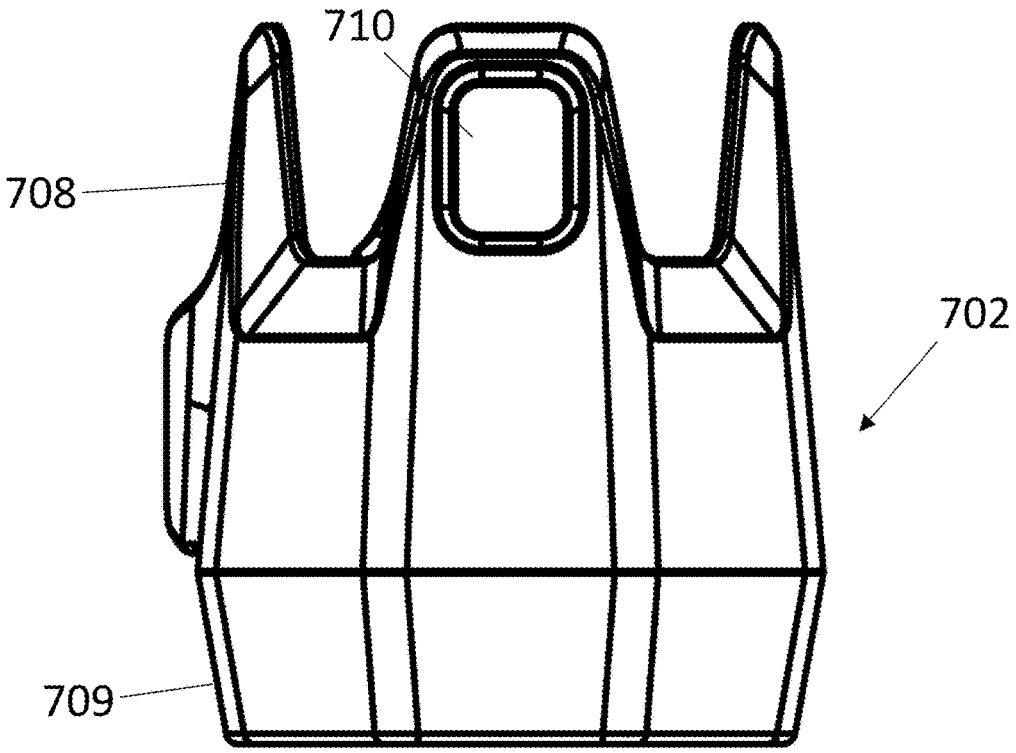
FIG. 8B illustrates a side view of a bottom pump overmold according to one embodiment of the present invention.
Figure 8C:
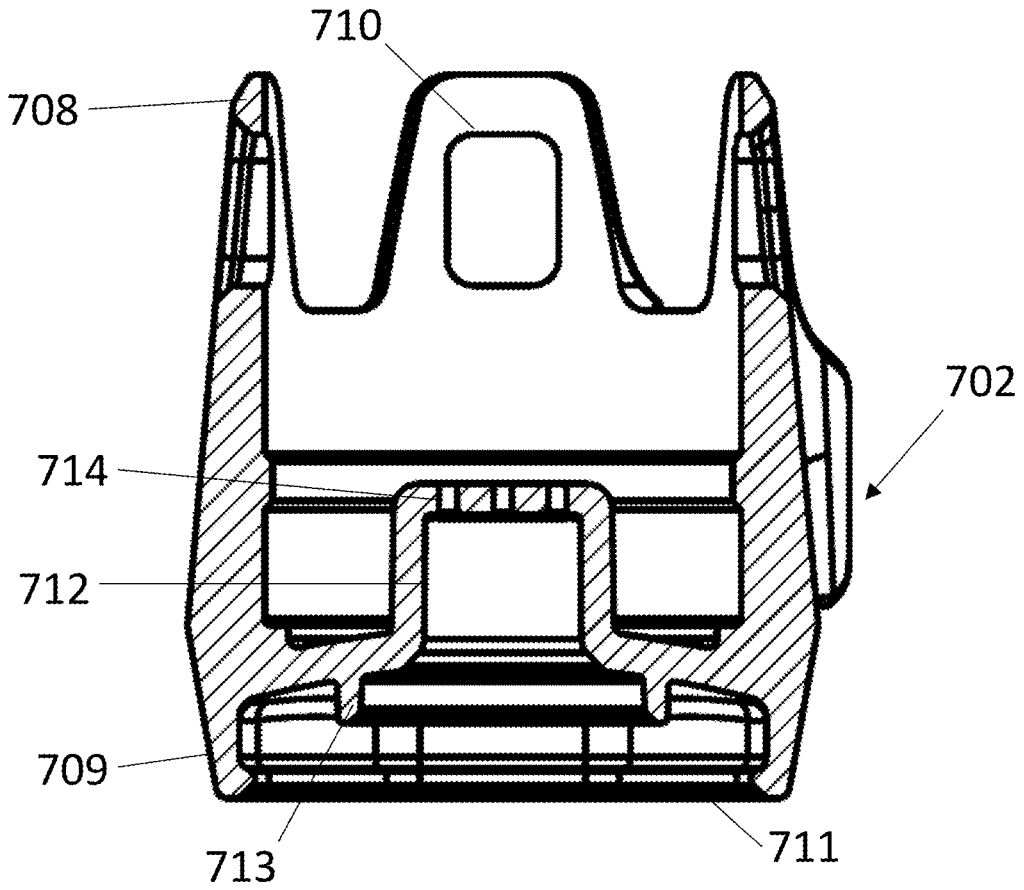
FIG. 8C illustrates a side sectional view of a bottom pump overmold according to one embodiment of the present invention.
Figure 8D:
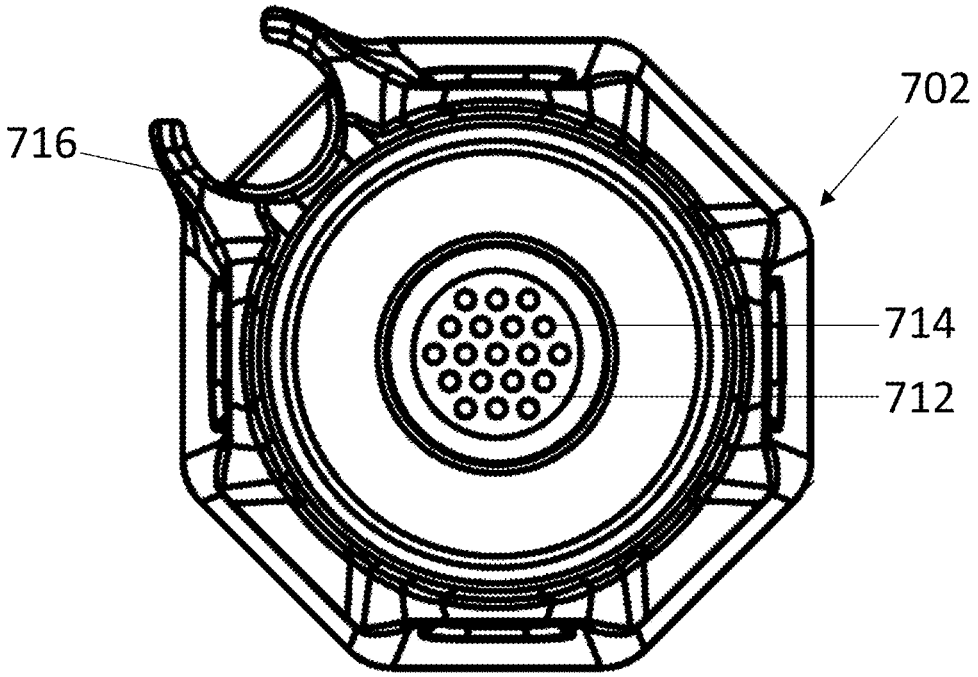
FIG. 8D illustrates a top view of a bottom pump overmold according to one embodiment of the present invention.

FIGS. 8A-8D illustrate a bottom pump overmold according to one embodiment of the present invention. The bottom overmold component 702 includes a base 709 from which a plurality of clasps 708 extend outwardly toward the same end of the base 709. In one embodiment, the clasps 708 taper inwardly. The clasps 708 each include one or more openings 710 configured to receive engagement tabs located on the central tube in order to affix the bottom overmold component 702 to the central tube. In one embodiment, as shown in FIG. 8A, the base 709 has a substantially octagonal cross-section, though one of ordinary skill in the art will understand that other shapes are also suitable for the present invention. Preferably, however, the shape of the base 709 matches the shape of the raised portion of the valve flange, such that the base 709 is able to fit tightly around the valve flange to sealingly connect the two components while air is being evacuated.

The base 709 includes a large opening 711 configured to receive the valve to connect the valve to the vacuum pump assembly. An outer rim of the large opening 711 includes an annular notch that is able to deflect when the vacuum pump assembly is pushed against the valve, to more firmly connect the vacuum pump assembly to the valve. A hollow cylinder 712 extends upwardly from the base 709 toward the clasps 708. The hollow cylinder 712 is open at a first end to the large opening 711, such that the interior of the hollow cylinder 712 and the large opening 711 form a common chamber. The second end of the hollow cylinder 712 includes a plurality of pores 714 through which air is able to flow into the tube from the valve. In one embodiment, surrounding the hollow cylinder 712, an annular (or otherwise shaped) shelf 713 extends upwardly into the large opening 711. In one embodiment, this annular shelf 713 is configured to fit around the valve body, in order to even more tightly connect the pump and the valve.

In one embodiment, a semi-circular (or otherwise shaped) claw 716 extends laterally from the base 709, such that the claw 716 is able to connect to hold a connection tube against the pump tube.

A connection tube is able to connect the valve assembly to the bottom overmold component to create an airflow channel between the pump assembly and the valve assembly, especially for situations where it geometrically convenient to directly connect the pump assembly to the valve assembly. In one embodiment, the connection tube is formed from a flexible polymer material (e.g., polyvinyl chloride (PVC)).

In one embodiment, the bottom overmold component 702 is formed from acrylonitrile butadiene styrene (ABS) rubber, though one of ordinary skill in the art will understand that other materials are also contemplated herein.

Figure 9A:
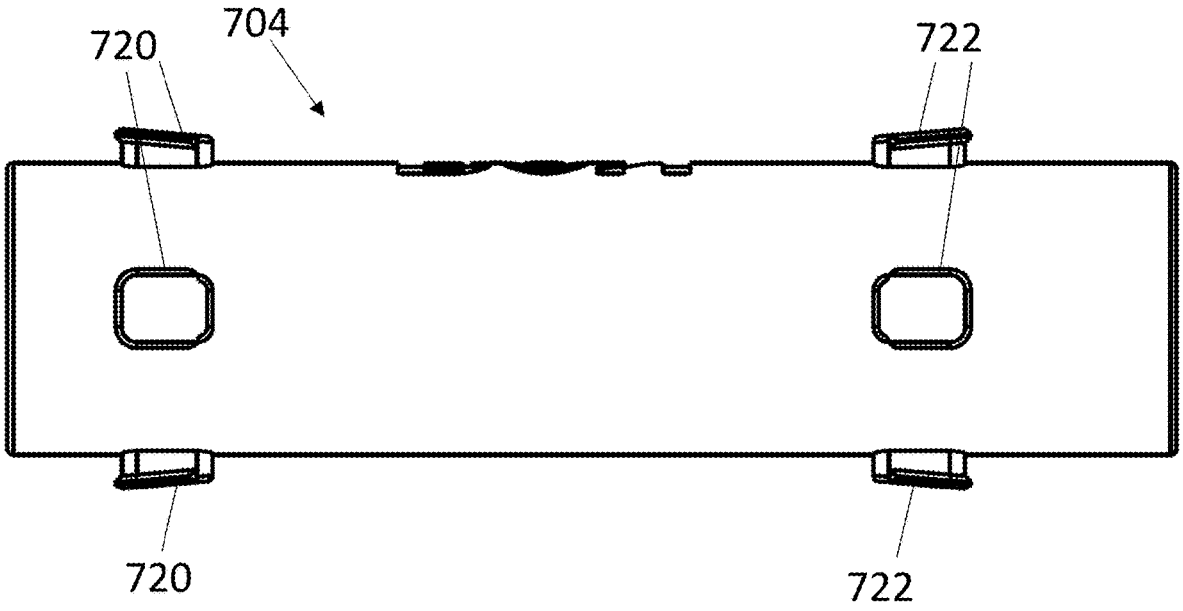
FIG. 9A illustrates a side view of a pump tube according to one embodiment of the present invention.
Figure 9B:
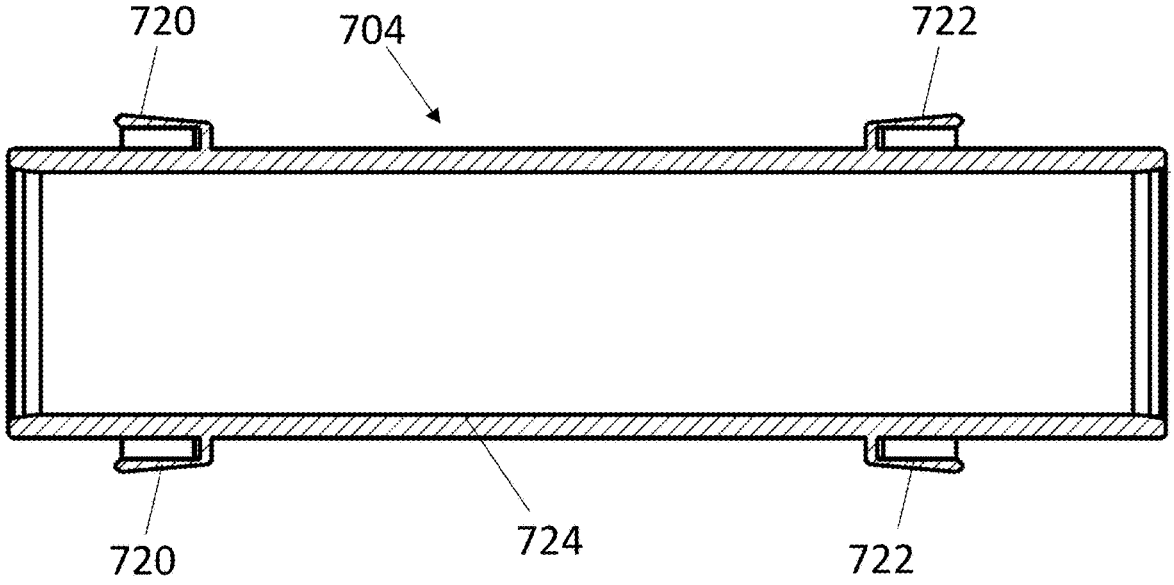
FIG. 9B illustrates a side sectional view of a pump tube according to one embodiment of the present invention.
Figure 9C:
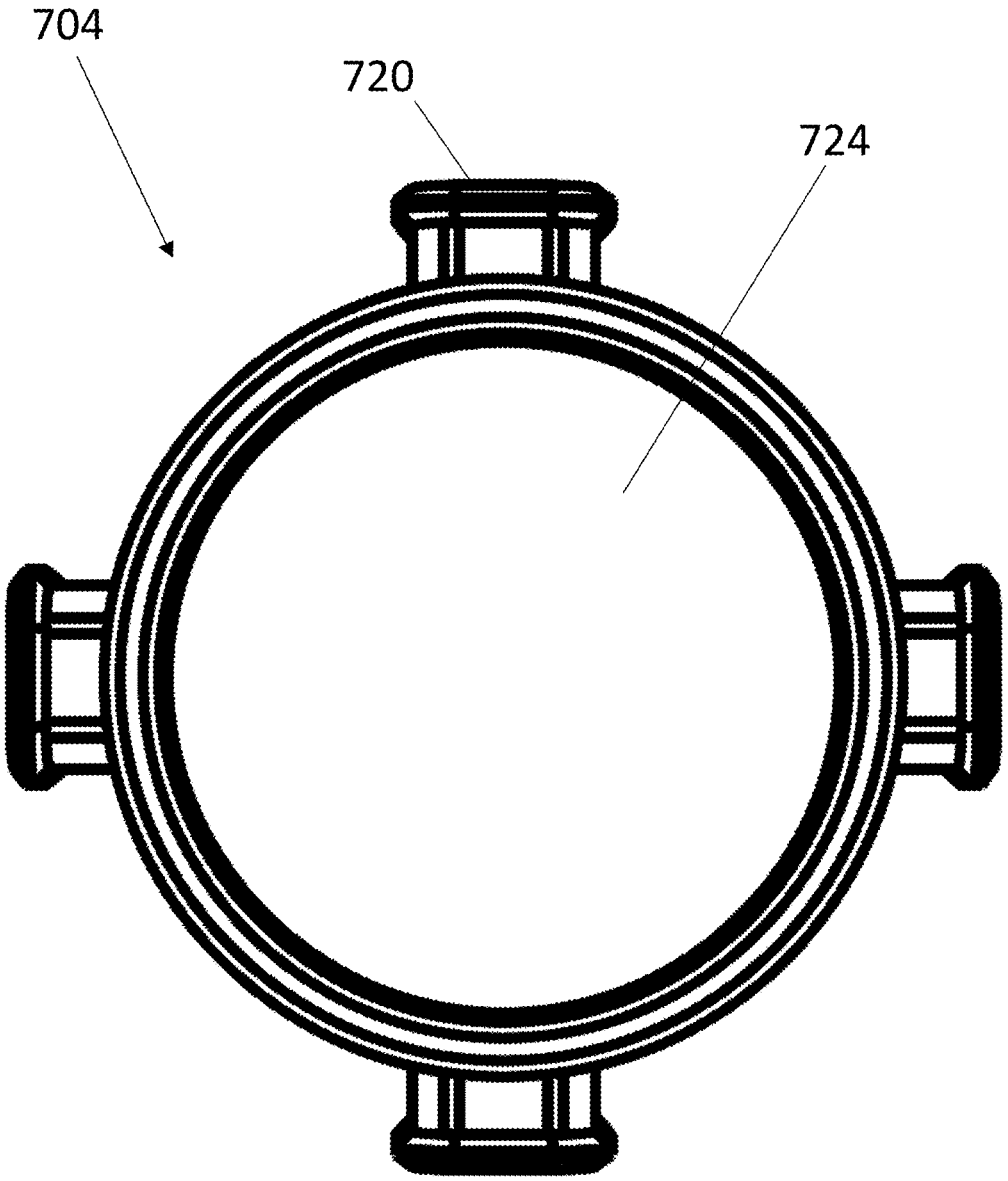
FIG. 9C illustrates a front view of a pump tube according to one embodiment of the present invention.
Figure 10A:
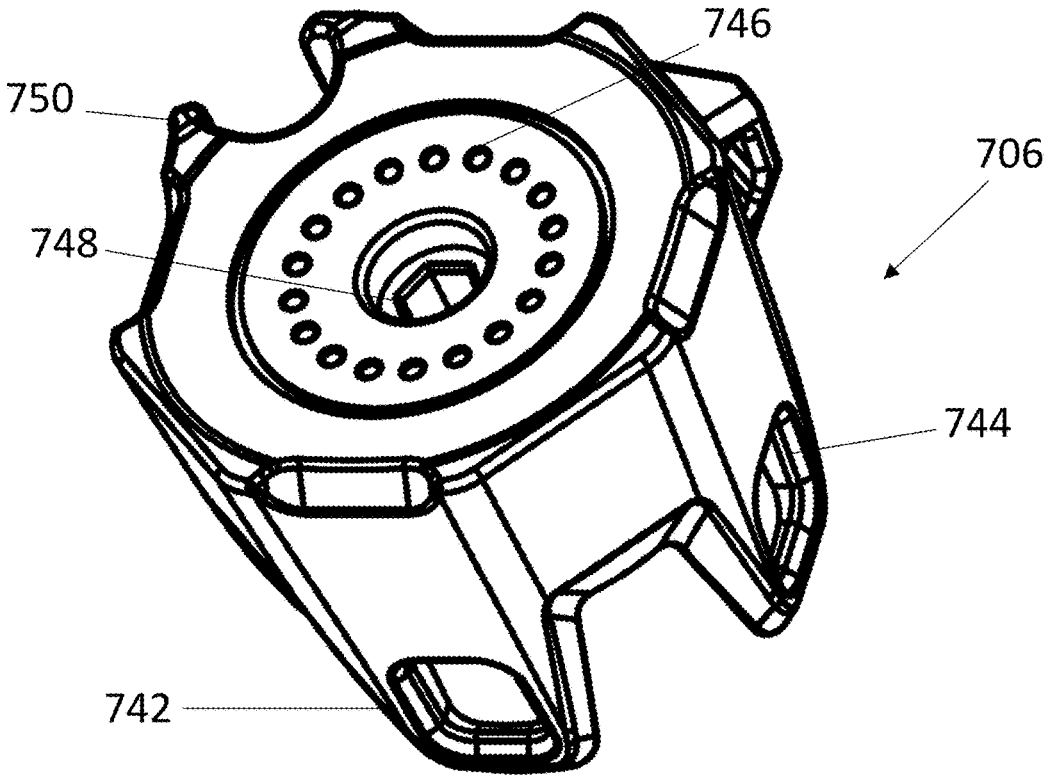
FIG. 10A illustrates a perspective view of a top pump overmold according to one embodiment of the present invention.
Figure 10B:
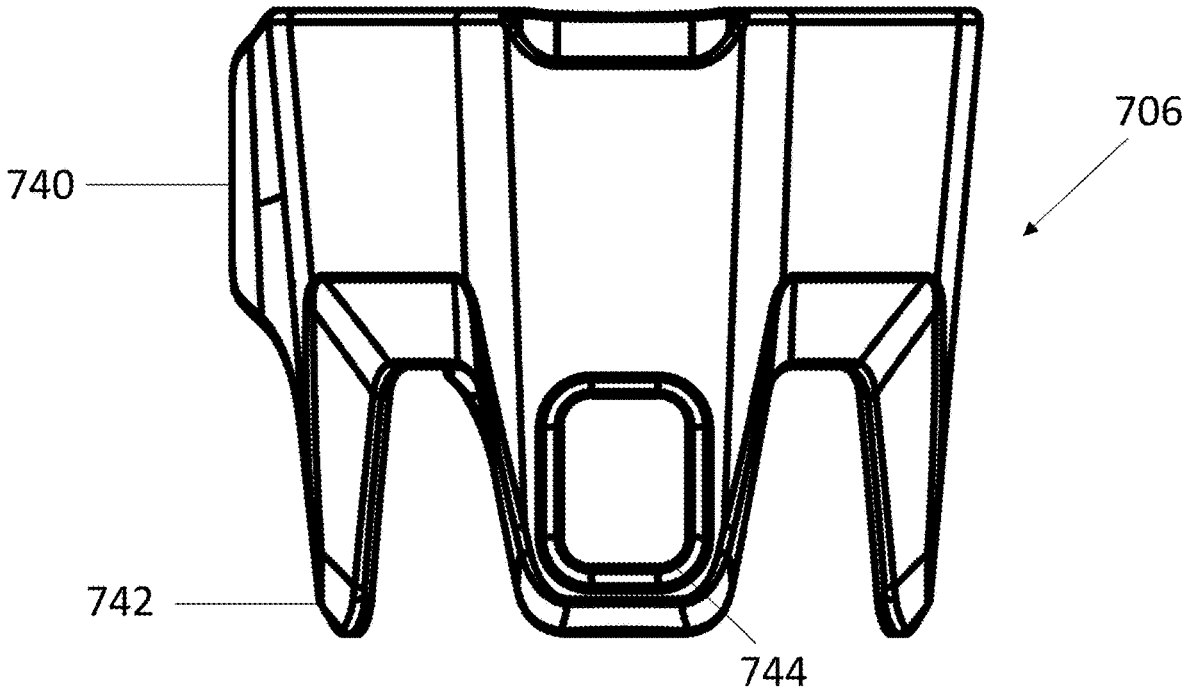
FIG. 10B illustrates a side view of a top pump overmold according to one embodiment of the present invention.
Figure 10C:
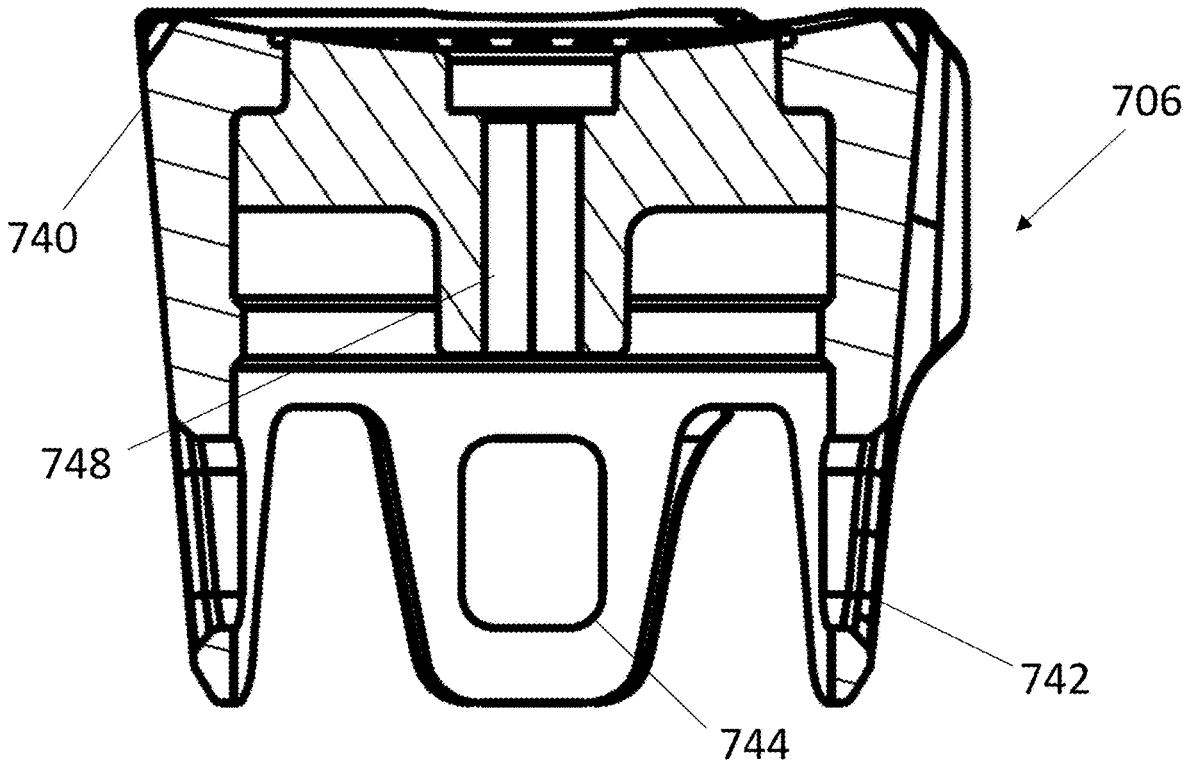
FIG. 10C illustrates a side sectional view of a top pump overmold according to one embodiment of the present invention.
Figure 10D:
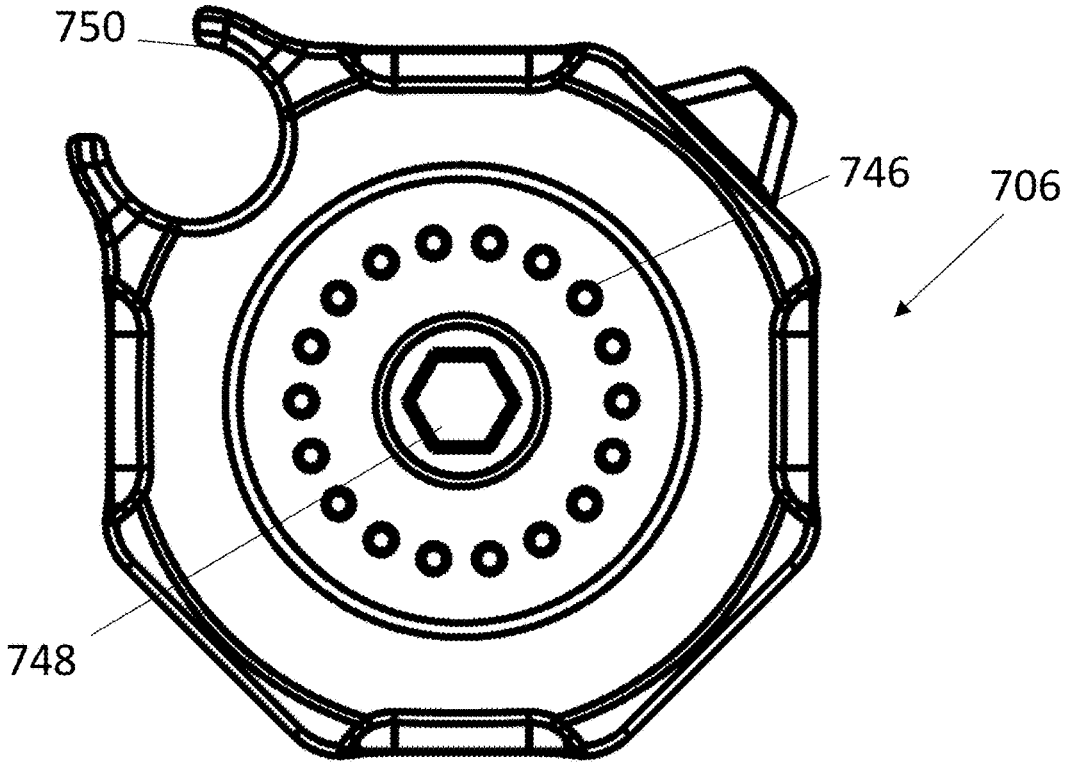
FIG. 10D illustrates a top view of a top pump overmold according to one embodiment of the present invention.
Figure 11A:
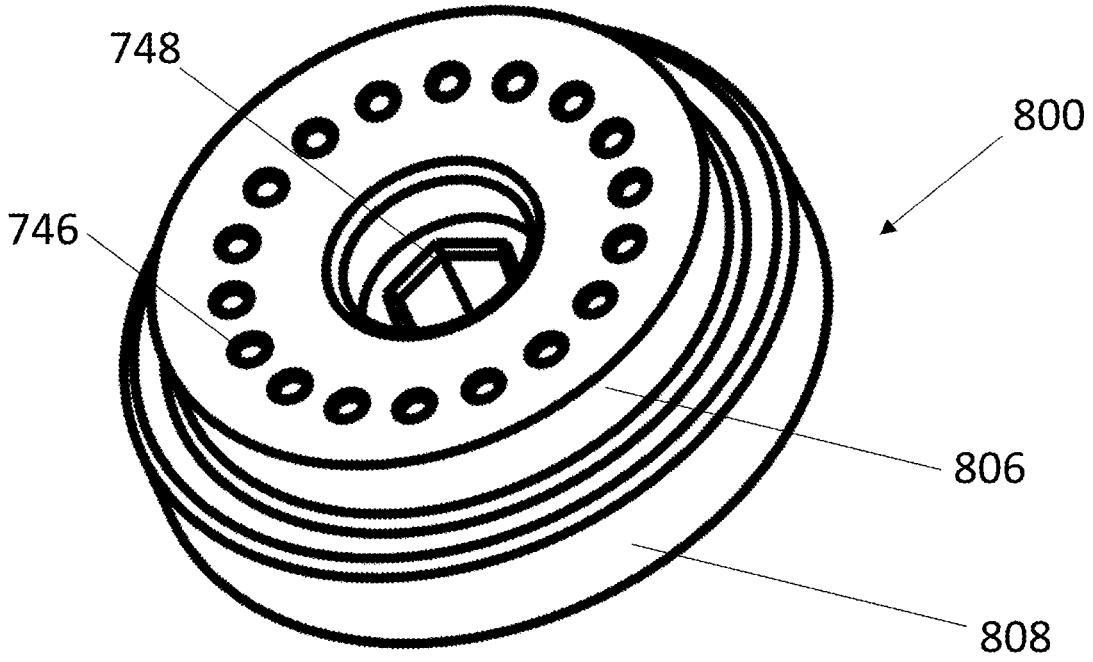
FIG. 11A illustrates a perspective view of an inner top overmold component for a pump assembly according to one embodiment of the present invention.
Figure 11B:
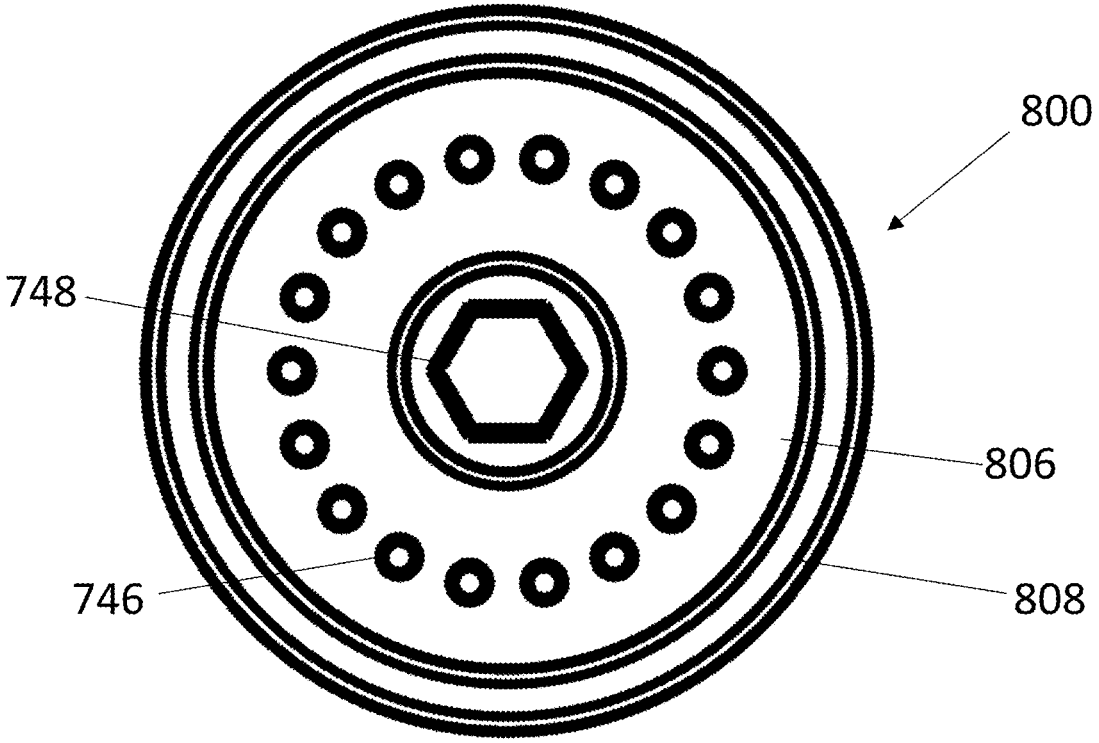
FIG. 11B illustrates a bottom view of an inner top overmold component for a pump assembly according to one embodiment of the present invention.
Figure 11C:
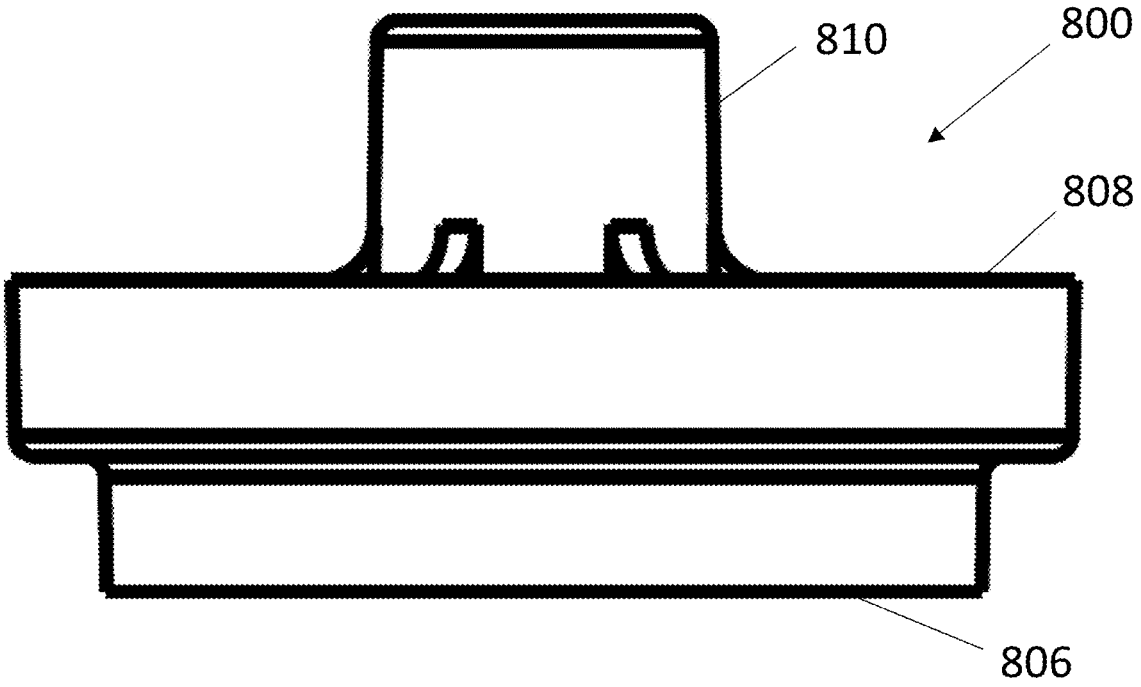
FIG. 11C illustrates a side view of an inner top overmold component for a pump assembly according to one embodiment of the present invention.
Figure 11D:
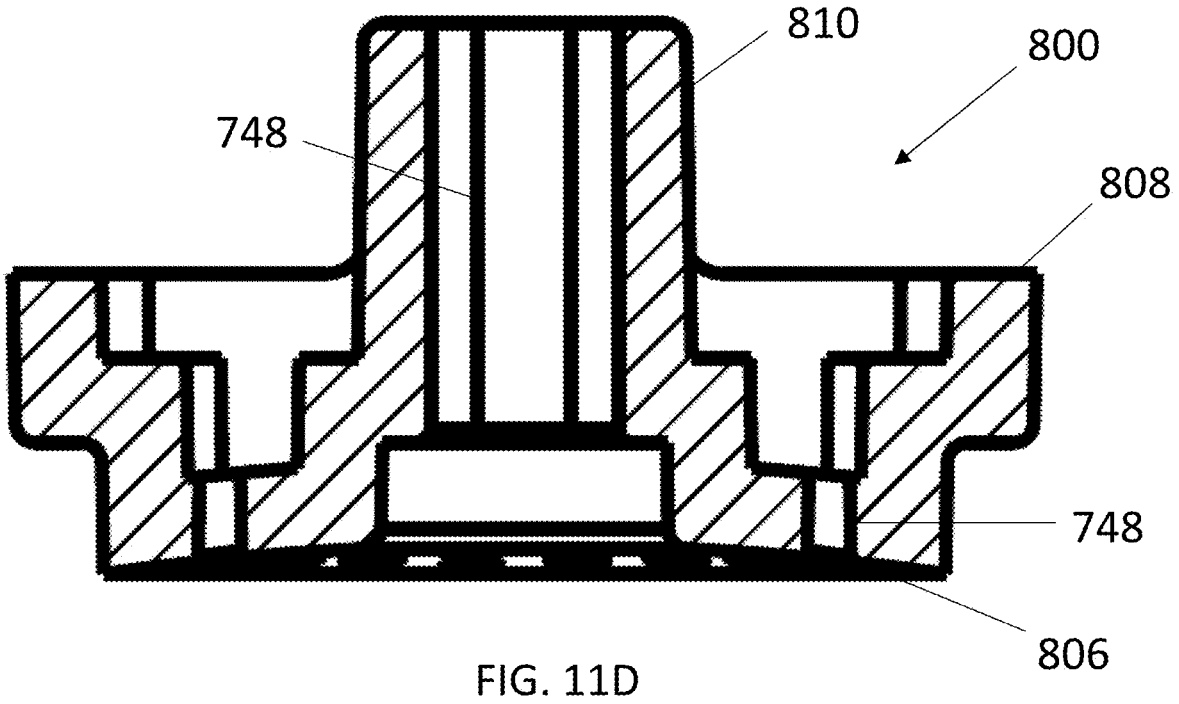
FIG. 11D illustrates a side sectional view of an inner top overmold component for a pump assembly according to one embodiment of the present invention.

FIGS. 9A-9C illustrate a pump tube according to one embodiment of the present invention. The tube 704 is preferably configured as a hollow cylinder, though one of ordinary skill in the art will understand that the tube 704 is also able to be a hollow rectangular prism, hexagonal prism, octagonal prism, or otherwise shaped. A first plurality of engagement tabs 720 extend outwardly proximate to a first end of the tube 704, while a second plurality of engagement tabs 722 extend outwardly proximate to a second end of the tube 704. The first plurality of engagement tabs 720 is configured to be received by the one or more openings of clasps of the bottom overmold component, while the second plurality of engagement tabs 722 are configured to be received by the one or more openings of clasps of the top overmold component, thereby connecting both overmold components firmly to the tube 704.

FIGS. 10A-10D illustrate a top pump overmold according to one embodiment of the present invention. The top overmold component 706 includes a base 740 from which a plurality of clasps 742 extend outwardly toward the same end of the base 740. In one embodiment, the clasps 742 taper inwardly. The clasps 742 each include one or more openings 744 configured to receive engagement tabs located on the central tube in order to affix the top overmold component 706 to the central tube. In one embodiment, the base 740 has a substantially octagonal cross-section, though one of ordinary skill in the art will understand that other shapes, including but not limited to circular, are also suitable for the present invention.

In one embodiment, a primary opening 748 is defined through approximately the center of the base 740. The primary opening 748 is configured to receive a shaft of a pump handle. The base 740 includes a plurality of secondary openings 746 surrounding the primary opening 748. The plurality of secondary openings 746 are able to serve as exhaust vents for air evacuated from the container of the vacuum retention system.

In one embodiment, a semi-circular (or otherwise shaped) claw 750 extends laterally from the base 740, such that the claw 750 is able to connect to hold a connection tube against the pump tube.

In one embodiment, the top overmold component 706 is formed from acrylonitrile butadiene styrene (ABS) rubber, though one of ordinary skill in the art will understand that other materials are also contemplated herein.

FIGS. 11A-11D illustrate an inner top overmold component for a pump assembly according to one embodiment of the present invention. In one embodiment, a central section 800 of the top overmold component, including the primary central opening 748 and the secondary openings 746, is detachable from the top overmold component. In one embodiment, the central section 800 includes a top portion 806 extending upwardly from a lower portion 808, where the top portion 806 has a smaller radius (or characteristic length) than the lower portion 808. In one embodiment, the top portion 806 and the lower portion 808 are substantially concentric. In one embodiment, the top portion 806 and/or the lower portion 808 have substantially circular cross-sections, but one of ordinary skill in the art will understand that other shapes are also contemplated herein.

In one embodiment, a hollow cylinder 810, through which the primary central opening 748 is defined, extends downwardly from the lower portion 808 of the central section 800.

Figure 12A:
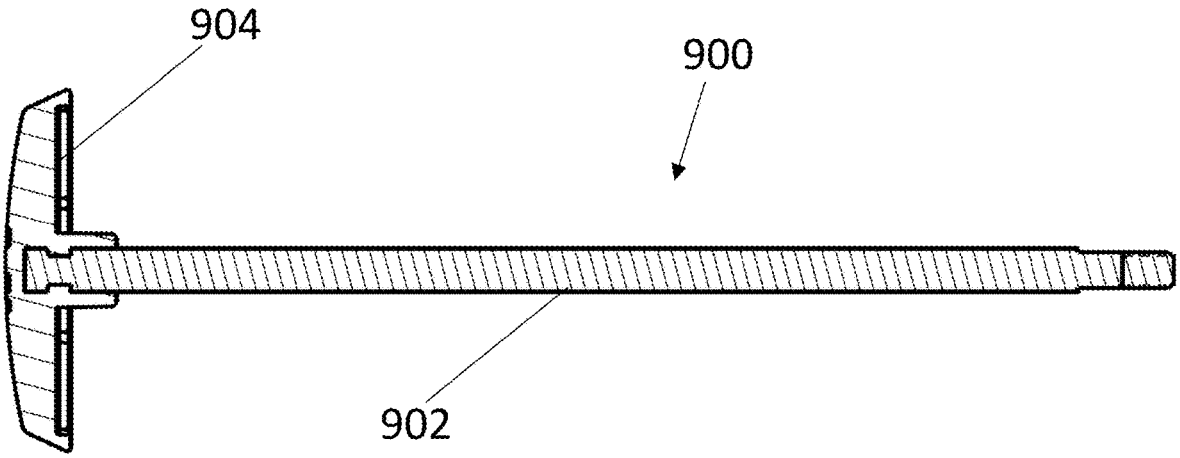
FIG. 12A illustrates a side view of a pump handle according to one embodiment of the present invention.
Figure 12B:
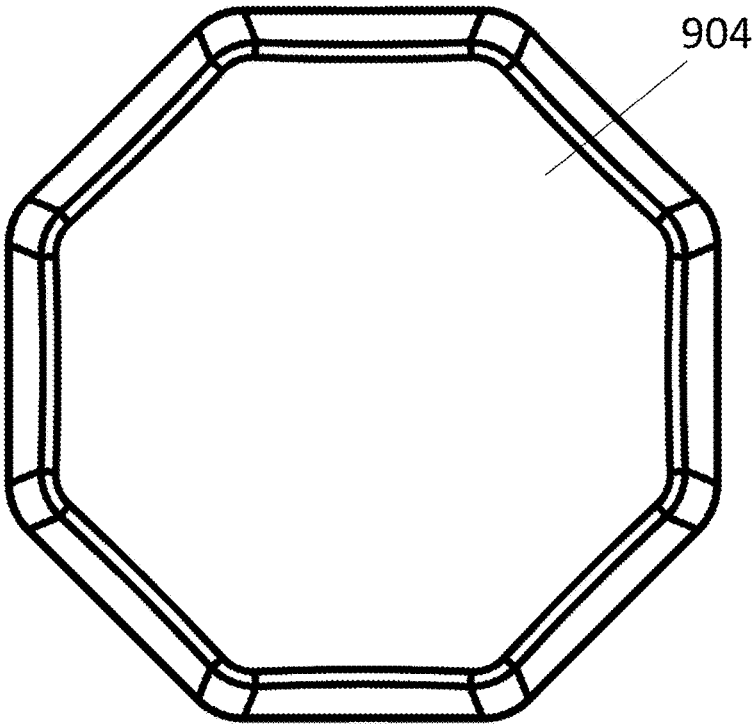
FIG. 12B illustrates a top view of a pump handle according to one embodiment of the present invention.

FIGS. 12A-12B illustrate a pump handle according to one embodiment of the present invention. The pump handle 900 includes a long shaft 902 configured to be inserted into the central primary opening in the top overmold component. The long shaft 902 is capped by a base 904, which, upon application of pressure by a user in a first direction, moves the long shaft 902 down into the tube, and, upon application of pressure by a user in a second direction, withdraws the long shaft 902 from the tube. In one embodiment, the base 904 is substantially octagonal in shape, but one of ordinary skill in the art will understand that other shapes, such as circular or hexagonal, are also contemplated herein. In one embodiment, the base 904 is sized and shaped substantially the same as the top of the top overmold component, such that, in a stowed position, the base 904 is able to lie flush with the top of the top overmold component, while the long shaft 902 is entirely within the tube.

Figure 13A:
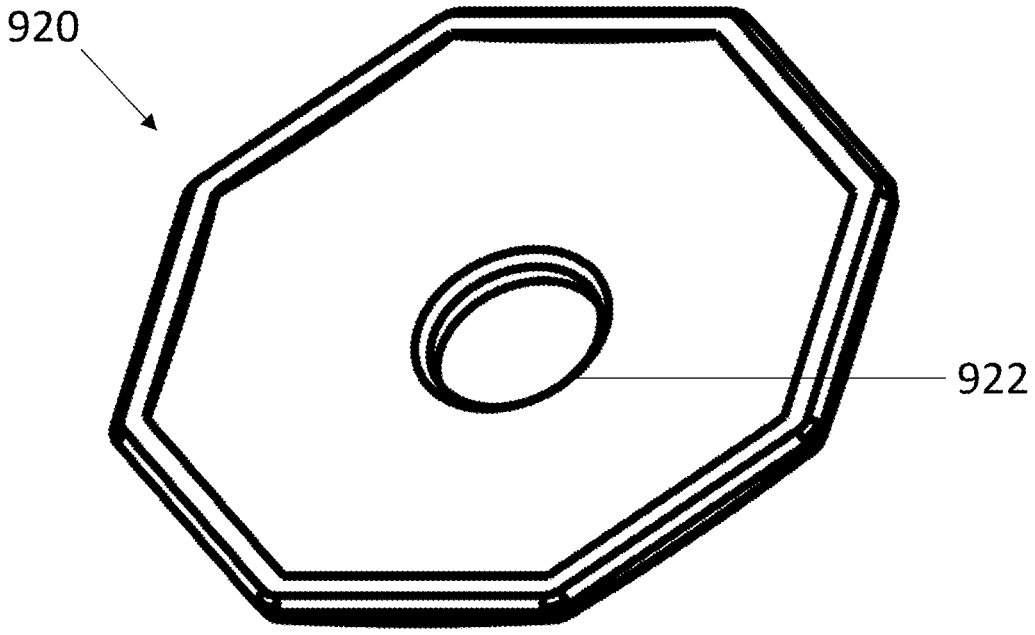
FIG. 13A illustrates a perspective view of a pump handle shelf according to one embodiment of the present invention.
Figure 13B:
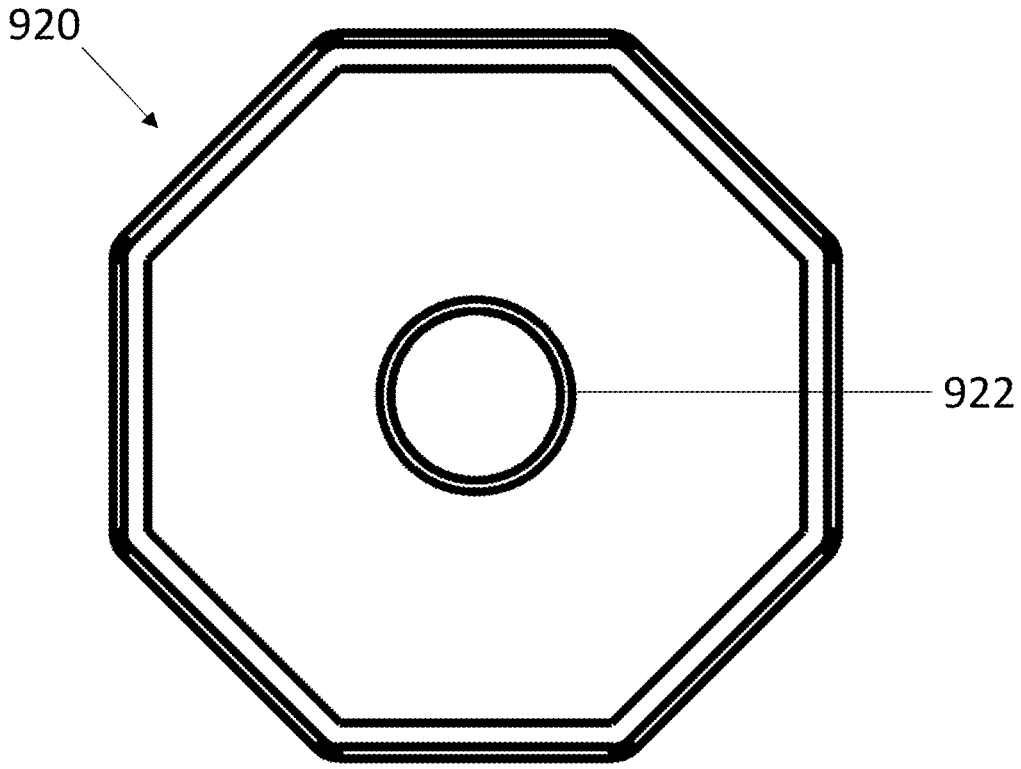
FIG. 13B illustrates a bottom view of a pump handle shelf according to one embodiment of the present invention.
Figure 13C:
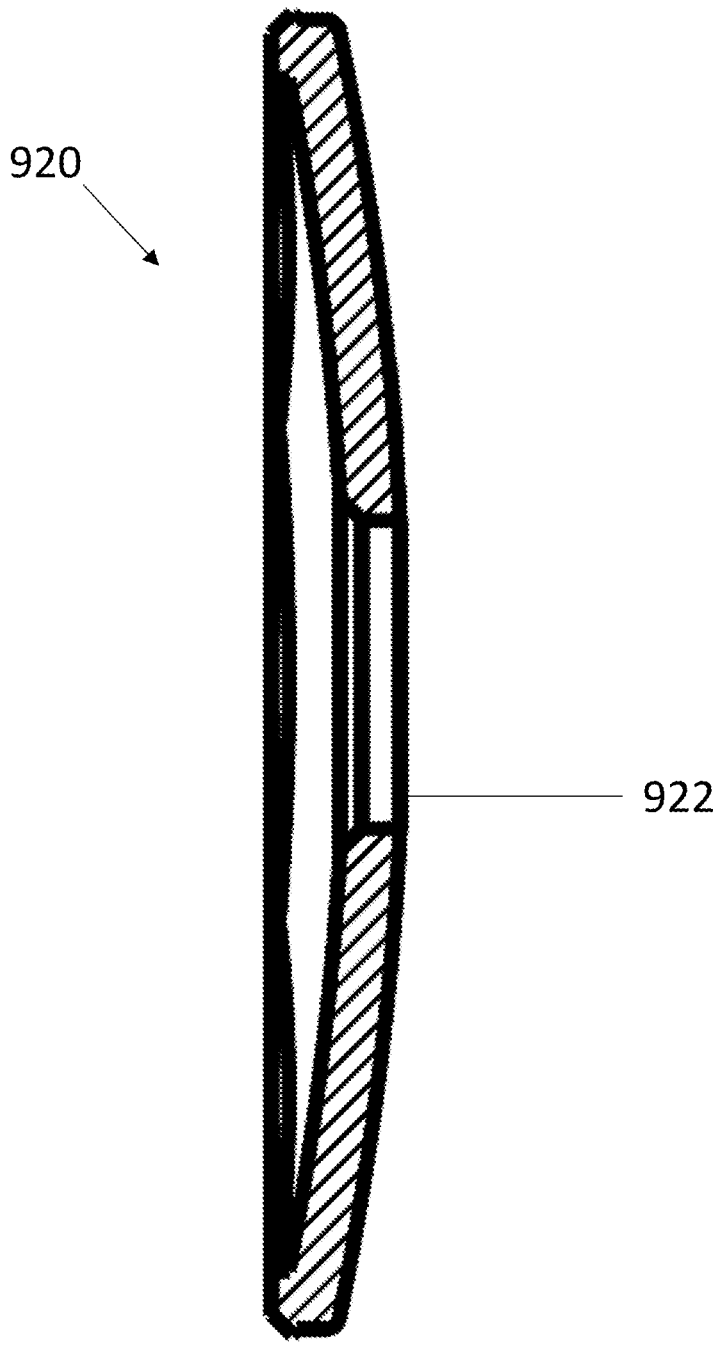
FIG. 13C illustrates a side view of a pump handle shelf according to one embodiment of the present invention.
Figure 14A:
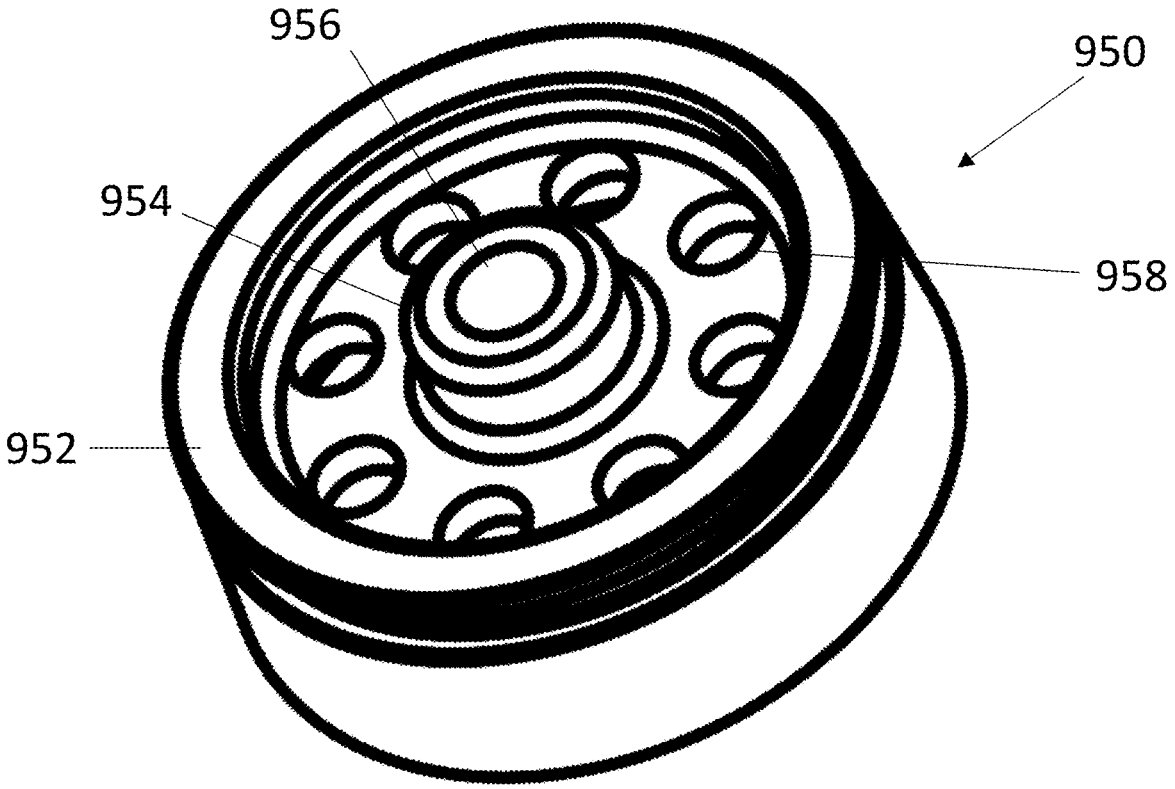
FIG. 14A illustrates a perspective view of an internal filter according to one embodiment of the present invention.
Figure 14B:
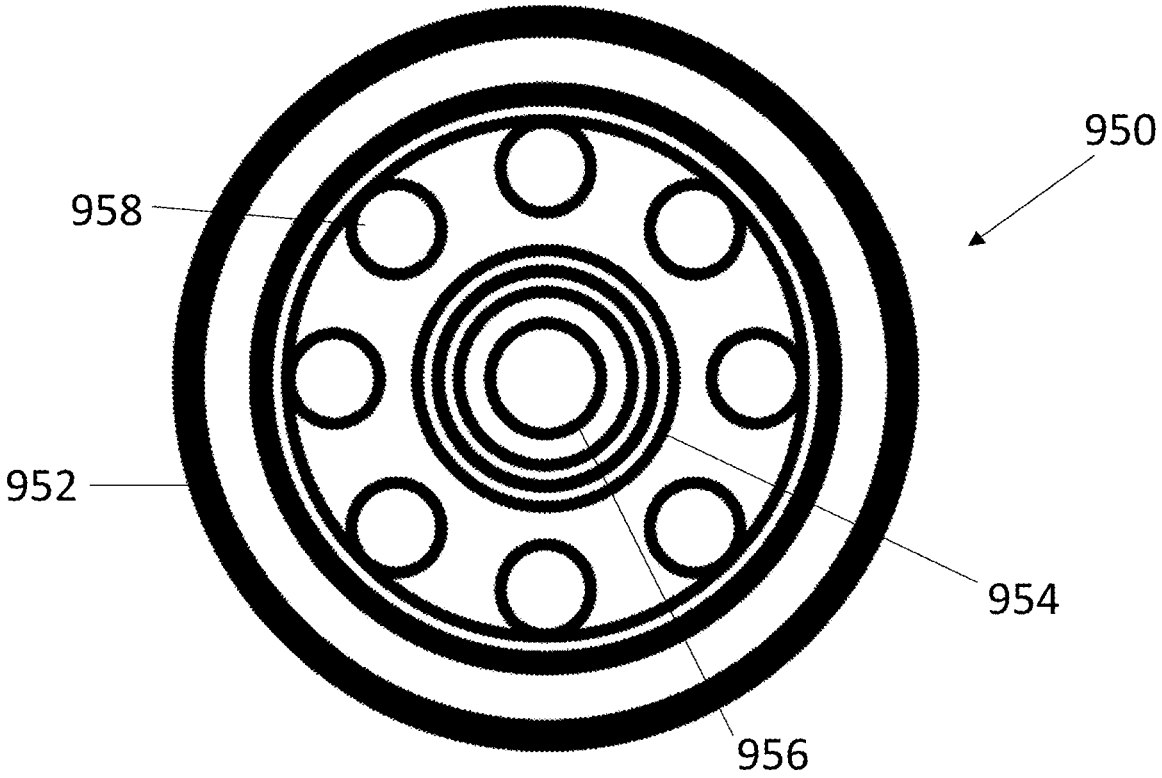
FIG. 14B illustrates a top view of an internal filter according to one embodiment of the present invention.
Figure 14C:
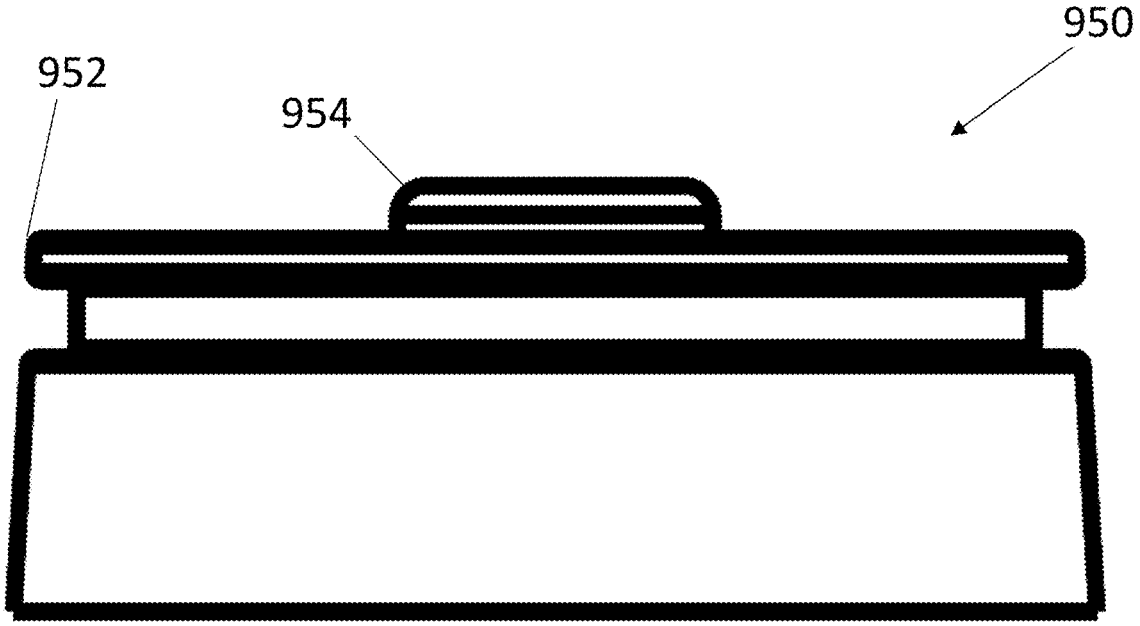
FIG. 14C illustrates a side view of an internal filter according to one embodiment of the present invention.
Figure 14D:
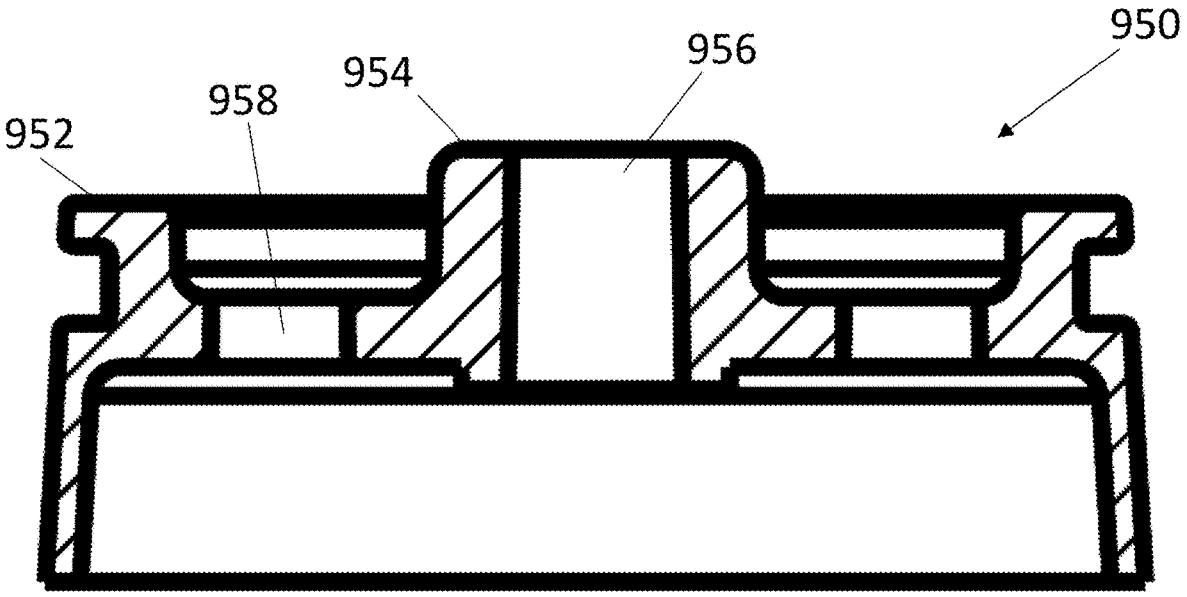
FIG. 14D illustrates a side sectional view of an internal filter according to one embodiment of the present invention.

FIGS. 13A-13C illustrate a pump handle shelf according to one embodiment of the present invention. A hole 922 in the pump handle shelf 920 is configured to fit around an end of the long shaft 902 opposite to the end connected to the base 904. In this way, the pump handle shelf 920 is positioned within the tube of the pump and helps to apply the negative pressure that allows the air to be evacuated from the container of the vacuum retention system. In one embodiment, the pump handle shelf 920 is substantially octagonal in shape, but one of ordinary skill in the art will understand that other shapes, such as circular or hexagonal, are also contemplated herein.

FIGS. 14A-14D illustrate a perspective view of an internal filter according to one embodiment of the present invention. The internal filter 950 is able to be positioned within the tube of the pump assembly and is able to allow the passage of air, while preventing ingress of materials above a size exclusion threshold. In one embodiment, the internal filter 950 includes a raised outer ring 952 around the circumference of the internal filter 950, surrounding a recessed area. A central extension 954 extends outwardly from a surface of the recessed area. In one embodiment, the central extension 954 does not extend beyond the raised outer ring 952. A central opening 956 is defined through the central extension 954. In one embodiment, the central opening 956 is sized and positioned to be able to receive the shaft of the pump handle. A plurality of secondary openings 958 are defined around the central extension 954 through a surface of the recessed area. In one embodiment, the plurality of secondary openings 958 are configured to be approximately the same size and shape of the plurality of secondary openings in the top overmold component. In one embodiment, the plurality of secondary openings 958 are configured to be a size and shape to define a size exclusion threshold and prevent movement of materials into the tube that are greater than the size exclusion threshold.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A vacuum pump assembly for withdrawing air from a vacuum retention system, comprising:

a hollow tube, wherein a plurality of tabs extending outwardly from an exterior surface of the hollow tube;

a bottom overmold component including a first plurality of clasps each with openings configured to matingly engage with the plurality of tabs;

a top overmold component including a second plurality of clasps each with openings configured to matingly engage with the plurality of tabs;

an internal filter within the hollow tube including a first plurality of air pores; and a handle;

wherein an attachment opening is defined in a bottom end of the bottom overmold component;

wherein the attachment opening includes a hollow cylinder having a second plurality of air pores;

wherein a central handle opening, into which the handle is inserted, is defined through a center of the top overmold component; and wherein a third plurality of air pores are defined in the top overmold component surrounding the central handle opening.

2. The vacuum pump assembly of claim 1, wherein the top overmold component and/or the bottom overmold component include one or more claws sized and shaped to hold a valve connection tube.

3. The vacuum pump assembly of claim 1, wherein the attachment opening is configured to matingly connect to a valve assembly of the vacuum retention system.

4. The vacuum pump assembly of claim 1, wherein the first plurality air pores are sized smaller than microbeads within the vacuum retention system.

5. The vacuum pump assembly of claim 1, wherein the handle is connected to a handle base having approximately the same size and shape as an upper surface of the top overmold component.

6. The vacuum pump assembly of claim 1, wherein the top overmold and/or the bottom overmold have octagonal cross-sections.

7. The vacuum pump assembly of claim 1, wherein the internal filter includes a central opening through which the handle is able to move.

8. The vacuum pump assembly of claim 1, wherein the plurality of tabs includes eight tabs.

9. A vacuum pump assembly for withdrawing air from a vacuum retention system, comprising:

a hollow tube, wherein a plurality of tabs extending outwardly from an exterior surface of the hollow tube;

a bottom overmold component including a first plurality of clasps each with openings configured to matingly engage with the plurality of tabs;

a top overmold component including a second plurality of clasps each with openings configured to matingly engage with the plurality of tabs; and a handle;

wherein an attachment opening is defined in a bottom end of the bottom overmold component;

wherein the attachment opening includes a hollow cylinder having a second plurality of air pores;

wherein a central handle opening, into which the handle is inserted, is defined through a center of the top overmold component; and wherein a third plurality of air pores are defined in the top overmold component surrounding the central handle opening;

wherein the attachment opening is configured to matingly connect to a valve assembly of the vacuum retention system; and wherein the valve assembly includes:

a valve flange integrated with a surface of the vacuum retention system, wherein the valve flange includes a central opening connecting an external environment to an interior of the vacuum retention system;

a valve body inserted into the central opening of the valve flange, wherein prongs extend downwardly from the valve body that are configured to clasp onto a retaining ring of the valve flange, thereby preventing the valve body from being pulled out of the valve flange;

at least one sealing element connected to the valve body, preventing ingress of air into the interior of the vacuum retention system when the valve assembly is in a closed position;

a diaphragm within an upper recess of the valve body, wherein the diaphragm is configured to limiting air flow through the valve assembly to a single direction; and a valve body insert within the upper recess of the valve body, above the diaphragm.

10. The vacuum pump assembly of claim 9, wherein the top overmold component and/or the bottom overmold component include one or more claws sized and shaped to hold a valve connection tube.

11. The vacuum pump assembly of claim 9, wherein the at least one sealing element includes at least one O-ring.

12. The vacuum pump assembly of claim 9, wherein a bottom surface defining the upper recess of the valve body includes a pore into which a needle of the diaphragm is inserted.

* * * * *